US009272223B2

(12) United States Patent
Checketts

(10) Patent No.: US 9,272,223 B2
(45) Date of Patent: Mar. 1, 2016

(54) SWING AMUSEMENT RIDE SYSTEM

(71) Applicant: Stanley J. Checketts, Providence, UT (US)

(72) Inventor: Stanley J. Checketts, Providence, UT (US)

( * ) Notice: Subject to any disclaimer, the term of this patent is extended or adjusted under 35 U.S.C. 154(b) by 0 days.

(21) Appl. No.: 14/460,179

(22) Filed: Aug. 14, 2014

(65) Prior Publication Data

US 2015/0051006 A1 Feb. 19, 2015

Related U.S. Application Data

(63) Continuation-in-part of application No. 14/159,117, filed on Jan. 20, 2014.

(60) Provisional application No. 61/865,933, filed on Aug. 14, 2013.

(51) Int. Cl.

| | |
|---|---|
| ***A63G 9/04*** | (2006.01) |
| ***A63G 21/20*** | (2006.01) |
| ***A63G 21/22*** | (2006.01) |

(52) U.S. Cl.

CPC *A63G 9/04* (2013.01); *A63G 21/20* (2013.01); *A63G 21/22* (2013.01)

(58) Field of Classification Search

CPC ..... A63G 9/04
USPC ..... 472/118
See application file for complete search history.

(56) References Cited

U.S. PATENT DOCUMENTS

| | | | | |
|---|---|---|---|---|
| 3,858,518 | A * | 1/1975 | Nyman | B61B 15/00 104/124 |
| 5,649,866 | A | 7/1997 | Balwanz | |
| 5,853,331 | A | 12/1998 | Ishikawa et al. | |
| 6,440,002 | B1 | 8/2002 | Jackson | |
| 6,666,773 | B1 * | 12/2003 | Richardson | F16D 63/008 104/204 |
| 2002/0162477 | A1 * | 11/2002 | Palumbo | B61B 7/00 104/87 |
| 2003/0144063 | A1 | 7/2003 | Cochron | |
| 2011/0083577 | A1 * | 4/2011 | Tilley | B61B 7/06 104/96 |
| 2011/0162917 | A1 * | 7/2011 | Steele | A63G 21/22 188/65.2 |
| 2013/0116604 | A1 | 5/2013 | Morilla et al. | |

FOREIGN PATENT DOCUMENTS

| | | |
|---|---|---|
| CN | 202686760 | 1/2013 |
| WO | 9519827 | 7/1995 |

OTHER PUBLICATIONS

Extended European Search Report, Patent Application No. 15151699.4 dated Apr. 30, 2015.

* cited by examiner

*Primary Examiner* — Michael Dennis
(74) *Attorney, Agent, or Firm* — Kunzler Law Group, PC

(57) ABSTRACT

An amusement ride system is disclosed. The amusement ride system includes a support subsystem that includes a loading location, a first location, and a second location. The support subsystem includes a first anchor cable extending between the loading location and the first location and a second anchor cable extending between the loading location and the second location, with a first trolley movably attached to the first anchor cable and a second trolley movably attached to the second anchor cable. A trolley actuation subsystem moves the first trolley and the second trolley along the length of the first anchor cable and the second anchor, respectively. A swing subsystem includes a passenger carriage, wherein a first swing line is coupled to the passenger carriage and pivotally engaged to the first trolley and a second swing line coupled to the passenger carriage and pivotally engaged to the second trolley.

15 Claims, 15 Drawing Sheets

SWING AMUSEMENT RIDE SYSTEM

CROSS-REFERENCE TO RELATED APPLICATIONS

This application is a continuation-in-part of U.S. patent application Ser. No. 14/159,117, filed on Jan. 20, 2014, and claims the benefit of U.S. Provisional Patent Application No. 61/865,933, filed on Aug. 14, 2013, which applications are incorporated herein by reference.

FIELD

The present disclosure relates to amusement rides, and more particularly relates to free-swinging amusement rides.

BACKGROUND

Swinging amusement rides are entertaining and provide exciting thrills to passengers. Often, swinging amusement rides have a support or an anchor point to which a swinging line is coupled. For some conventional swinging amusement rides that span large gaps, the support can be a cable that extends in a horizontal direction and is elevated a distance above the ground. In such configurations, the swinging motion is often in a direction that is perpendicular to the horizontal direction of the support. In other words, most conventional swinging systems have a bar extending horizontally that is supported in the elevated position by mounting structures. A swing line is attached to the bar and the swinging direction is orthogonal to the direction of the bar.

However, in certain situations it is difficult to efficiently usher passengers through a swinging amusement ride system. For example, after a ride is completed and the passenger(s) has substantially stopped swinging, ride attendants must perform the loading/unloading operations at the bottom of the swinging arc before returning the passenger carriage to a launch point. Returning the passenger carriage to the launch point can be difficult and time consuming. For example, since the swinging motion occurs in a direction perpendicular to the direction of the support bar, conventional amusement systems must have mounting structures at each end of the support and a launching structure at a third elevated point separate from the two mounting structures. Thus, conventional swinging amusement ride systems generally require three separate elevated points.

SUMMARY

From the foregoing discussion, it is apparent that a need exists for an amusement ride system that more effectively ushers passengers through a ride and provides passengers with a high thrill factor. Beneficially, such a system would allow passengers to efficiently be loaded, swing across large gaps or chasms, and be unloaded. The subject matter of the present disclosure has been developed in response to the present state of the art, and in particular, in response to the problems and needs in the art that have not yet been fully solved by currently available amusement ride systems. Accordingly, the subject matter of the present disclosure has been developed to provide an amusement ride system that may overcome many or all of the above-discussed or other shortcomings in the art.

An amusement ride system is disclosed. One embodiment of the amusement ride system includes a support subsystem that includes a loading location, a first location, and a second location that are all elevated a distance above the ground and that are spaced apart in a triangular formation. The support subsystem further includes a first anchor cable extending between the loading location and the first location and a second anchor cable extending between the loading location and the second location. The amusement ride system further includes a first trolley movably attached to the first anchor cable and a second trolley movably attached to the second anchor cable. Still further, the amusement ride system includes a trolley actuation subsystem that moves the first trolley and the second trolley along the length of the first anchor cable and the second anchor, respectively, and a swing subsystem that includes a passenger carriage. The swing subsystem includes a first swing line coupled to the passenger carriage and pivotally engaged to the first trolley and a second swing line coupled to the passenger carriage and pivotally engaged to the second trolley.

In one implementation, the first location and the second location are different locations on a single interconnected tower structure. In another implementation, the amusement ride system further includes a passenger loading subsystem. The passenger loading subsystem includes a platform and a securing mechanism. The platform temporarily engages the passenger carriage while loading and unloading passengers and the securing mechanism temporarily secures the passenger carriage while loading and unloading passengers. According to one implementation, the platform includes moveable floor panels that can be retracted or rotated to a launch position and the passenger carriage can be positioned so that passengers look substantially straight down to the ground when the floor panels are retracted or rotated to the launch position.

According to one implementation, the passenger carriage is a first passenger carriage, and the amusement ride further includes a passenger loading subsystem. The passenger loading subsystem includes a tower and a second passenger carriage that is movably coupled to the tower and that at least one of rapidly ascends and rapidly descends translationally along the tower to position a passenger proximate the first passenger carriage.

In another implementation, the swing subsystem further includes a swing line drive motor for extending and retracting the first swing line and the second swing line. The amusement ride system may further include a swing line tension subsystem to which the first swing line and the second swing line are anchored. The swing line tension subsystem controls slack and tension in the first swing line and the second swing line. According to one implementation, the swing line tension subsystem includes a swing line drive motor for extending and retracting the first swing line and the second swing line. The swing line tension subsystem may include shock absorber elements and the first anchor cable and the second cable may each include two cables tensioned to 5,000 pounds. In one implementation, the passenger carriage has a seat for positioning a passenger in a seated position and the seat is a tandem seat for positioning two passengers side-by-side in the seating position.

The present disclosure also relates to another embodiment of an amusement ride system. The amusement ride system includes a support subsystem that has a loading location, a first location, and a second location that are all elevated a distance above the ground and that are spaced apart in a triangular formation. The support subsystem further includes a first anchor cable extending between the loading location and the first location and a second anchor cable extending between the loading location and the second location. The amusement ride system further includes a first trolley movably attached to the first anchor cable and a second trolley movably attached to the second anchor cable. The amusement ride system further includes a trolley actuation subsystem that moves the first trolley and the second trolley along the length of the first anchor cable and the second anchor, respectively. Still further, the system includes a swing subsystem that includes a passenger carriage, a first swing line coupled to the passenger carriage and pivotally engaged to the first trolley, and a second swing line coupled to the passenger carriage and pivotally engaged to the second trolley. The system may also include a swing line tension subsystem to which the first swing line and the second swing line are anchored. The swing line tension subsystem controls slack and tension in the first swing line and the second swing line. The system also includes a passenger loading subsystem that includes a platform and a securing mechanism, wherein the platform temporarily supports passengers and ride attendants while loading and unloading passengers, and the securing mechanism temporarily secures the passenger carriage while loading and unloading passengers.

In one implementation, the swing line tension subsystem includes a single drive motor that controls extension and retraction of both the first swing line and the second swing line.

The present disclosure also relates to one embodiment of an amusement ride method. The method includes loading a passenger into a passenger carriage at a loading location. A first swing line and a second swing line are interconnected between the passenger carriage and a first trolley and a second trolley, respectively, with the first trolley and the second trolley being movably attached to a first anchor cable and a second anchor cable, respectively. The method also includes moving the first trolley and the second trolley away from the loading location and positioning the passenger carriage into a launching position at the loading location. The method further includes releasing the passenger carriage from the loading location to swing and then moving the first trolley and the second trolley towards the loading location to unload the passenger from the passenger carriage.

According to one implementation, positioning the passenger carriage into a launching position includes adjusting one or more of slack and tension in the first swing line and the second swing line. According to another implementation, moving the passenger carriage towards the loading location to unload the passenger from the passenger carriage includes adjusting one or more of slack and tension in the first swing line and the second swing line. In one implementation, a first length of the first swing line between the passenger carriage and the first trolley and a second length of the second swing line between the passenger carriage and the second trolley are elongated as the first trolley and the second trolley move away from the loading location. According to the same implementation, the first length and the second length are shortened as the first trolley and the second trolley move toward the loading location.

Reference throughout this specification to features, advantages, or similar language does not imply that all of the features and advantages that may be realized with the subject matter of the present disclosure should be or are in any single embodiment of the subject matter. Rather, language referring to the features and advantages is understood to mean that a specific feature, advantage, or characteristic described in connection with an embodiment is included in at least one embodiment of the subject matter of the present disclosure. Thus, discussion of the features and advantages, and similar language, throughout this specification may, but do not necessarily, refer to the same embodiment.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter of the present disclosure will be readily understood, a more particular description of the subject matter will be rendered by reference to specific embodiments that are illustrated in the appended drawings. Understanding that these drawings depict only typical embodiments of the subject matter of the present disclosure and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the subject matter of the present disclosure, however, absent an express correlation to indicate otherwise, an implementation may be associated with one or more embodiments.

Figure 1A:
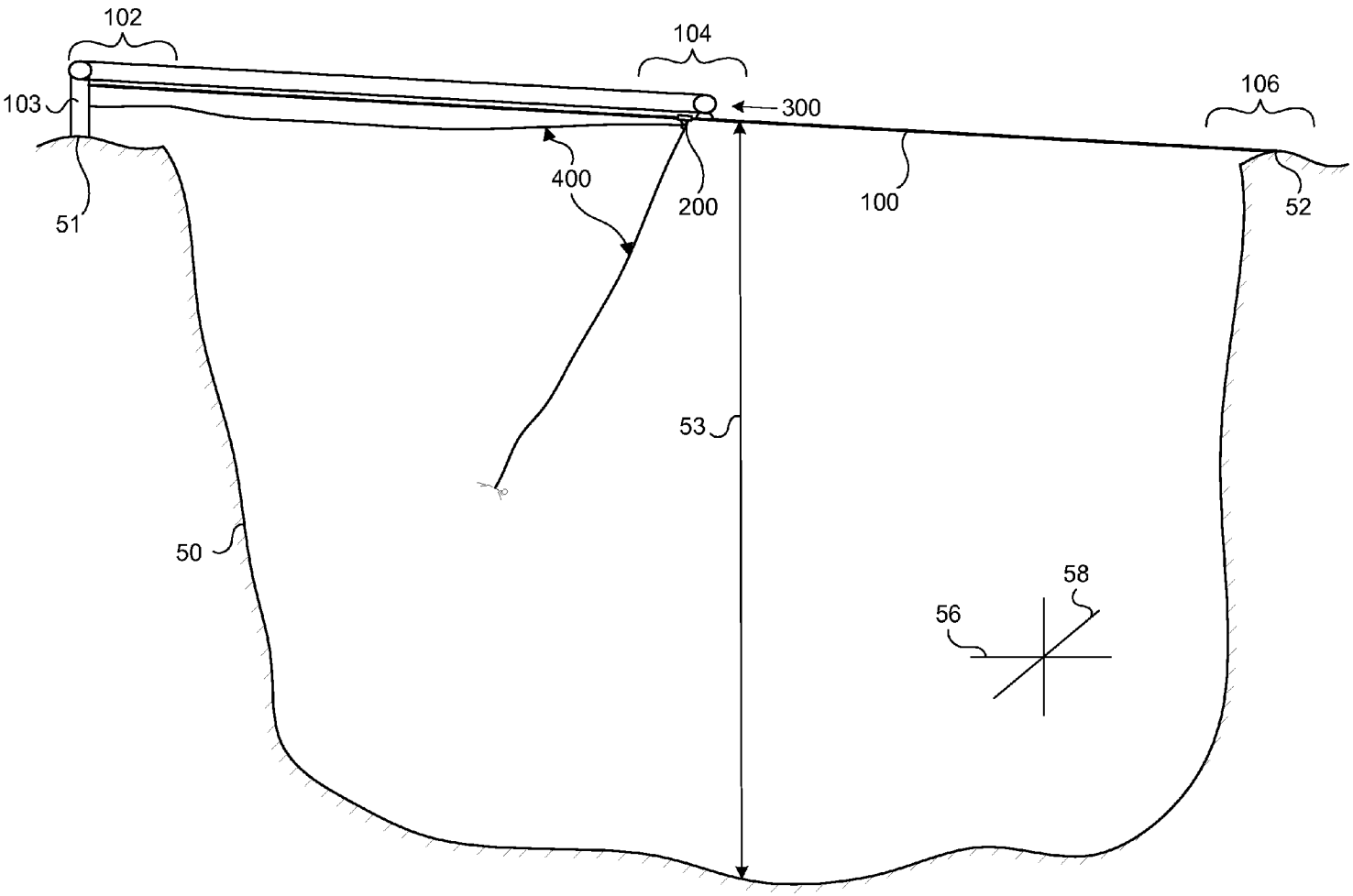
FIG. 1A depicts one embodiment of an amusement ride system for swinging a passenger on a swing line.

FIG. 1A depicts one embodiment of an amusement ride system for swinging a passenger or passengers on a swing line. The depicted embodiment of the system includes a support component 100 extending across a canyon 50, a trolley 200, a retraction subsystem 300, and a swing subsystem 400. The trolley 200, the retraction subsystem 300, and the swing subsystem 400 are described below in greater detail with reference to FIGS. 2-5. Generally, the amusement ride of the present disclosure provides a system for swinging a passenger carriage on a swing line, wherein the swing line pivots about a trolley that is movably attached to a support component that is spanning a gap.

The system of the present disclosure provides a support component 100 extending between two points 51, 52 in a first horizontal direction 56, which can be substantially horizontal (e.g., slightly angled as shown or significantly angled if necessary). At least a portion 104 of the support component 100 that extends between the two points 51, 52 is suspended a distance 53 above the ground. In other words, the support component 100 includes at least three segments, a first anchored segment 102 affixed to the first point 51, a medial segment 104 suspended a distance 53 above the ground, and a second anchored segment 106 affixed to the second point 52. Thus, the two points 51, 52 are elevated above the ground so that a user may achieve a swinging motion while being supported by the support component 100. Therefore, throughout the present disclosure, the term "ground" will be used to refer to a location that is lower in elevation than the first and second points 51, 52 and does not necessarily refer to ground level (i.e., the swing system may be constructed on top of a large structure with towers comprising the first and second points 51, 52).

In one embodiment, as depicted in FIG. 1A, the first point 51 and the second point 52 are actually walls or cliffs of a canyon 50 and the ground is actually the valley floor. In other embodiments, the elevated points 51, 52 may be the walls/cliffs of a gorge, valley, ravine, gap, gulch, or chasm. The support component 100 may be affixed at the first and second points 51, 52 via conventional securing assemblies. For example, steel supports may be driven into the face of the canyon and the support component 100 may be coupled thereto.

Figure 1B:
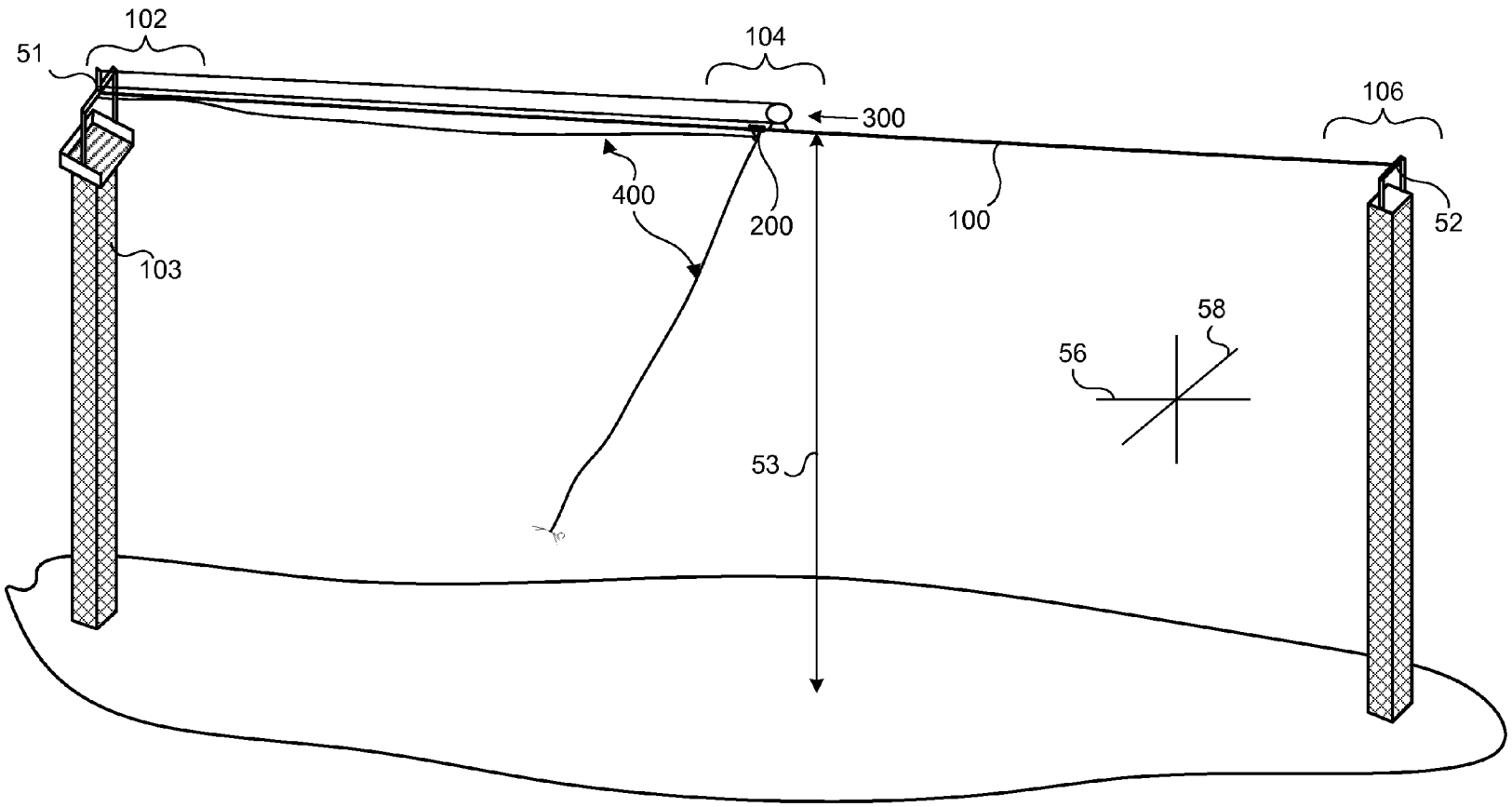
FIG. 1B depicts another embodiment of an amusement ride system for swinging a passenger on a swing line.

FIG. 1B, however, depicts another embodiment of an amusement ride system for swinging a passenger or passengers on a swing line. In FIG. 1B, the first point 51 and the second point 52 may be man-made (e.g., manufactured) structures, such as buildings and/or towers. For example, in one implementation, each of the first and second points 51, 52 may be defined by respective first and second manufactured towers (e.g., buildings, structures, beams) that extend from the ground. The first tower 103 that defines the first point 51 may have stairs or an integrated elevator that transports passengers up the tower to ride the amusement ride system and down the tower to exit the amusement ride system after riding the amusement ride attraction. The towers may be constructed of metal scaffolding, cement, and/or other construction materials. In one embodiment, the first point 51 or the second point 52 may be a manufactured tower while the other may be a wall or cliff of a canyon (i.e., a natural structure). The manufactured towers may also include tensioned support cables anchored to the ground (not depicted) configured to stabilize and shore up the towers.

The support component 100, in one embodiment, may be a cable or a plurality of cables. For example, the support component 100 may comprise two ¾ inch steel cables that extend across the entire canyon 50, which can have walls that extend upwards of 4,000 feet above the valley floor, in some implementations. The cables may be tensioned to around 5,000 pounds and may each have a rating of 85,000 pounds, according to one embodiment. In another embodiment, the support component 100 may be constructed of a rigid material spanning the distance between the two points 51, 52, such as a beam or a truss structure. The support component may also include other elements, such as a tower 103. While the system in FIGS. 1A and 1B depicts the tower 103 as an element of the first anchored segment 102 of the support component 100, the distinction between whether the tower 103 is an element of the support component 100 or an element of the canyon 50 is not important. In other words, throughout the present disclosure, the use of the word "tower" as an element of the first anchored segment 102 of the support component 100 should not limit the scope of the disclosure in any way.

Figure 2:
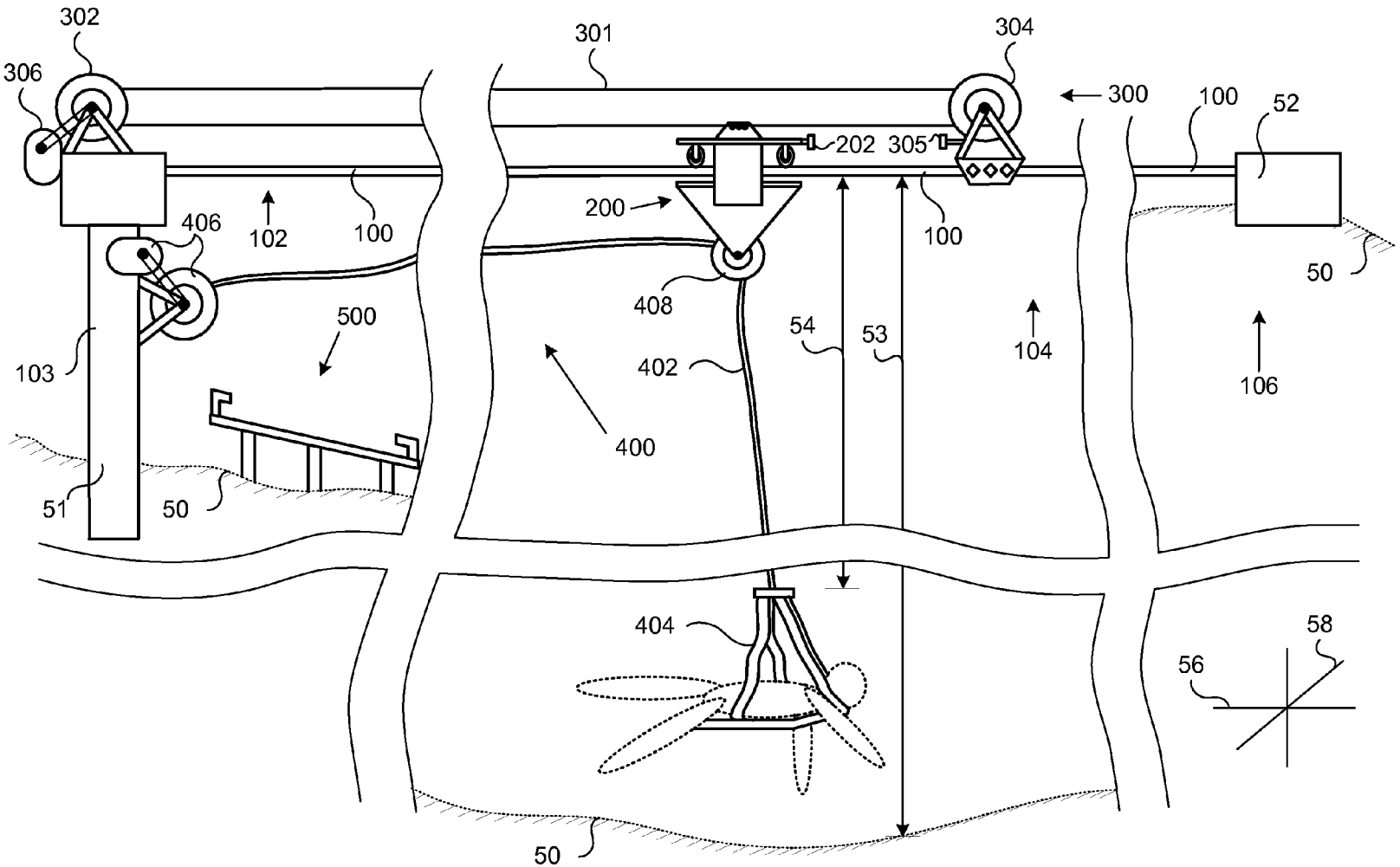
FIG. 2 depicts one embodiment of an amusement ride system for swinging a passenger on a swing line with the swing line affixed to a first anchored segment of a support component.

FIG. 2 depicts one embodiment of an amusement ride system for swinging a passenger on a swing line with the swing line affixed to the first anchored segment 102 of the support component 100. As described above, the amusement ride system disclosed in the present application includes a support component 100 (described above with reference to FIGS. 1A and 1B), a trolley 200, a retraction subsystem 300, and a swing subsystem 400. The embodiment depicted in FIG. 2 also includes a passenger loading subsystem 500, which is described below with reference to FIG. 3. The trolley 200, the retraction subsystem 300, and the swing subsystem 400 are all supported and sustained by the support component 100. More specifically, the trolley 200 is movably attached to the support component 100 so as to slide, roll, glide or otherwise move along the length of the support component 100 in the first horizontal direction 56. The retraction subsystem 300 powers the movement of the trolley 200 back and forth along the length of the support component 100. The swing subsystem 400 attaches to or engages the trolley 200 in such a manner so as to allow a passenger to be pivoted about the trolley 200 in a swinging motion when the trolley 200 is located near the medial segment 104 of the support component.

As mentioned, the trolley 200 is an element of the system that is movably attached to the support component 100. The trolley 200 may be positioned near the medial segment 104 of the support component 100 while the passenger is swinging but may be positioned near the first anchored segment 102 of the support component 100 while the passenger is being loaded or unloaded into the amusement ride. For example, in one embodiment the trolley 200 includes a pulley or a sheave engaged on a cable (support component 100) so as to be freely movable along the length of the cable. The trolley 200 may also include a tethering mechanism 202 for temporarily anchoring the trolley to the medial segment 104 of the support component 100 during swinging. The trolley 200 may also be embodied in other devices that are capable of being moved along a cable or a beam. For example, the trolley 200 may be a rollercoaster-type trolley with wheels engaging both the upper and lower surfaces of the support component 100.

The retraction subsystem 300, as briefly described above, is configured to move the trolley 200 along the support component 100 between the first anchored segment 102 and the medial segment 104. According to one embodiment, the retraction subsystem 300 may include a trolley line 301 affixed to the trolley 200, a first pulley member 302 affixed to the first anchored segment 102 of the support component 100, a medial pulley member 304 affixed to the medial segment 104 of the support component 100, and a reversible trolley line drive motor 306 for extending and retracting the trolley line 301. The trolley line 301 may comprise, for example, two ¼ inch cables extending between the two pulley members 302, 304 and affixed to the trolley. In another embodiment, the trolley line 301 comprises belts or straps extending between the pulley members 302, 304. The pulley members 302, 304 may include drums, sheaves, or barrels for engaging the trolley line 301.

According to one embodiment, the medial pulley member 304 may be affixed to the medial segment 104 of the support component 100 by clamping or permanently fastening to the support component 100. Also, the medial pulley member 304 may include a tethering mechanism part 305 compatible with the tethering mechanism 202 on the trolley 200, wherein the trolley 200 can be temporarily fastened and secured indirectly to the medial segment 104 of the support component 100 (via the medial pulley member 304). Throughout the pages of the disclosure, the term pulley is used to refer to a wheel or roller that has a groove for engaging a belt, rope, or cable (e.g., a sheave).

Because the two pulley members 302, 304 are affixed to the support component 100, the trolley line drive motor 306 can power the rotation of one of the pulley members to retract/extend the trolley line 301, thus moving the affixed trolley 200 along the length of the support component 100. The trolley line drive motor 306 may be affixed to the first anchored segment 102 of the support component 100 (i.e. affixed to the tower 103 as depicted in FIG. 2) and may drive the rotation of the first pulley member 302. In another embodiment, the trolley line drive motor 306 may be affixed to the medial segment 104 of the support component 100 and may drive the rotation of the medial pulley member 304. According to yet another embodiment, the pulley line drive motor 306 may not actually be a stand-alone element of the system but may be integrated into one of the pulley members 302, 304. It is contemplated the one of ordinary skill in the art will recognize other retraction-type systems that may be employed in the present disclosure for moving a trolley along a support line. For example, the trolley 200 may include an integrated motor for moving the trolley along the support component from the passenger unloading/loading location to the medial location, such that a retraction subsystem 300 may not be needed.

The swing subsystem 400, according to one embodiment, includes a swing line 402, a passenger carriage 404, a swing line drive motor 406, and a swing line pulley member 408. The swing line 402 may be any cable, rope, or cord capable of supporting the weight of at least one passenger and the passenger carriage 404. According to one embodiment, the swing line 402 is constructed of two ¼ inch cables. The passenger carriage 404 may be a harness for securely holding a person to the swing line 402. In another embodiment, the passenger carriage 404 may include a chair, reclining member, or other personal supporting apparatus for positioning the passenger in various positions during the swing trajectory (e.g., head forward and lying on one's stomach, sitting down facing forwards, sitting down facing backwards, hanging upside down, etc.). According to one embodiment, the passenger carriage 404 may be configured to hold a single passenger or the carriage 404 may be configured to hold multiple passengers. For example, the passenger carriage 404 may be a tandem seat that positions two passengers side-by-side. The passenger carriage 404 may include straps, buckles, belts, fasteners, clamps, ties, padding, arm supports, leg supports, neck/head supports, etc. It is contemplated that those of skill in the art will recognize other devices and mechanisms for securely swinging a person on a line that fall within the scope of this disclosure.

The swing line drive motor 406, according to the depicted embodiment, may be affixed to the first anchored segment 102 of the support component 100 (i.e., affixed to the tower 103) and the swing line pulley member 408 may be affixed to the trolley. Similar to the trolley line drive motor 306 described above with reference to FIG. 2, the swing line drive motor 406 may be a component of a pulley, sheave, or drum or the swing line drive motor 406 may drive the rotation of a pulley/drum upon and around which the swing line 402 coils and uncoils during retraction and extension, respectively. The swing line drive motor 406 is capable of retracting and extending the swing line 402 through and across the swing line pulley member 408, thereby decreasing and increasing, respectively, the length 54 of the swing line 402 between the trolley 200 and the passenger carriage 404. The length 54 of the swing line 402 between the trolley 200 and the passenger carriage 404 should be less than the distance 53 between the medial segment 104 of the support component 100 and the ground to prevent the passenger carriage 404 from making contact with the ground during swinging.

Figure 4:
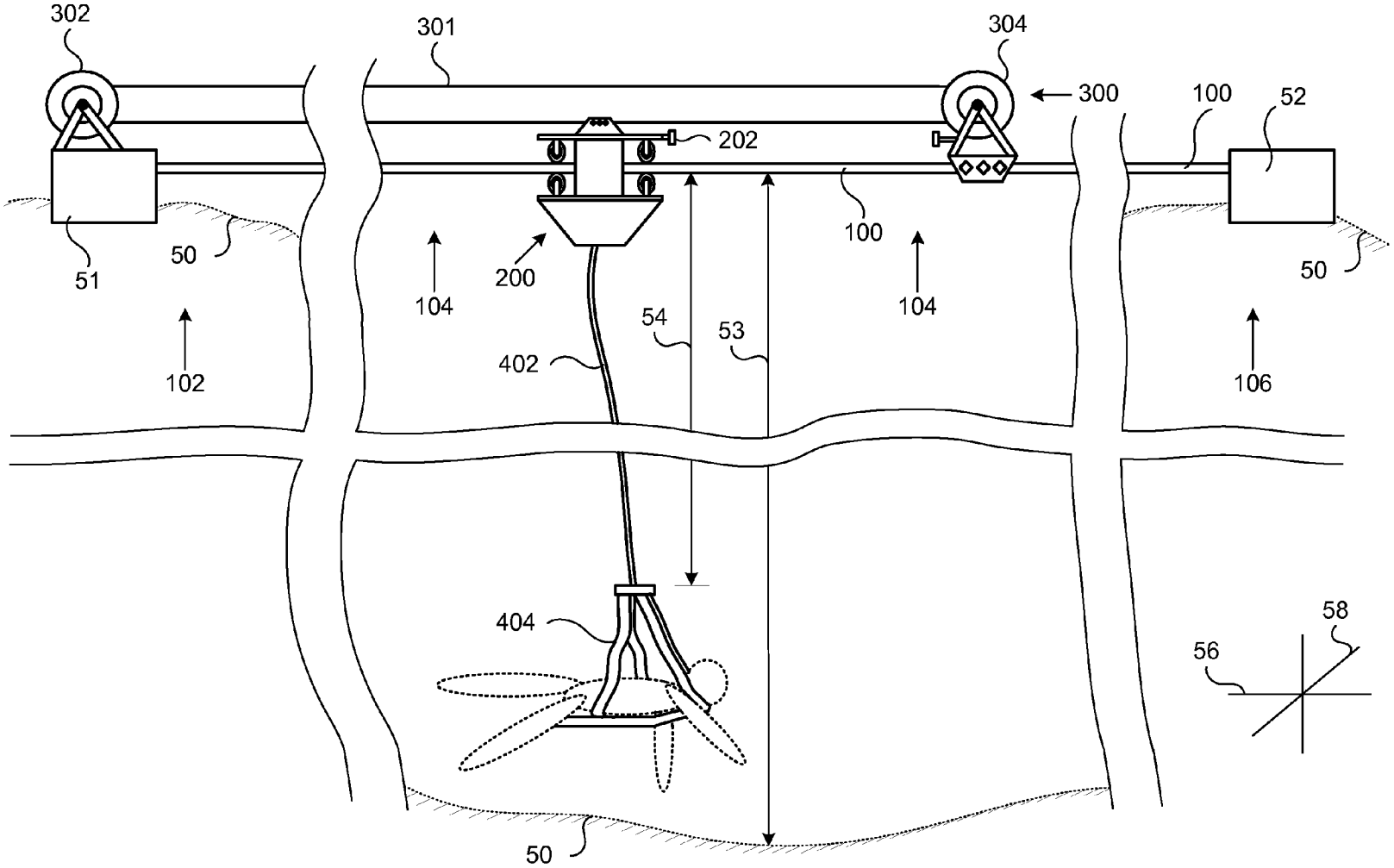
FIG. 4 depicts one embodiment of an amusement ride system for swinging a passenger on a swing line with the swing line affixed to a moveable trolley.
Figure 5:
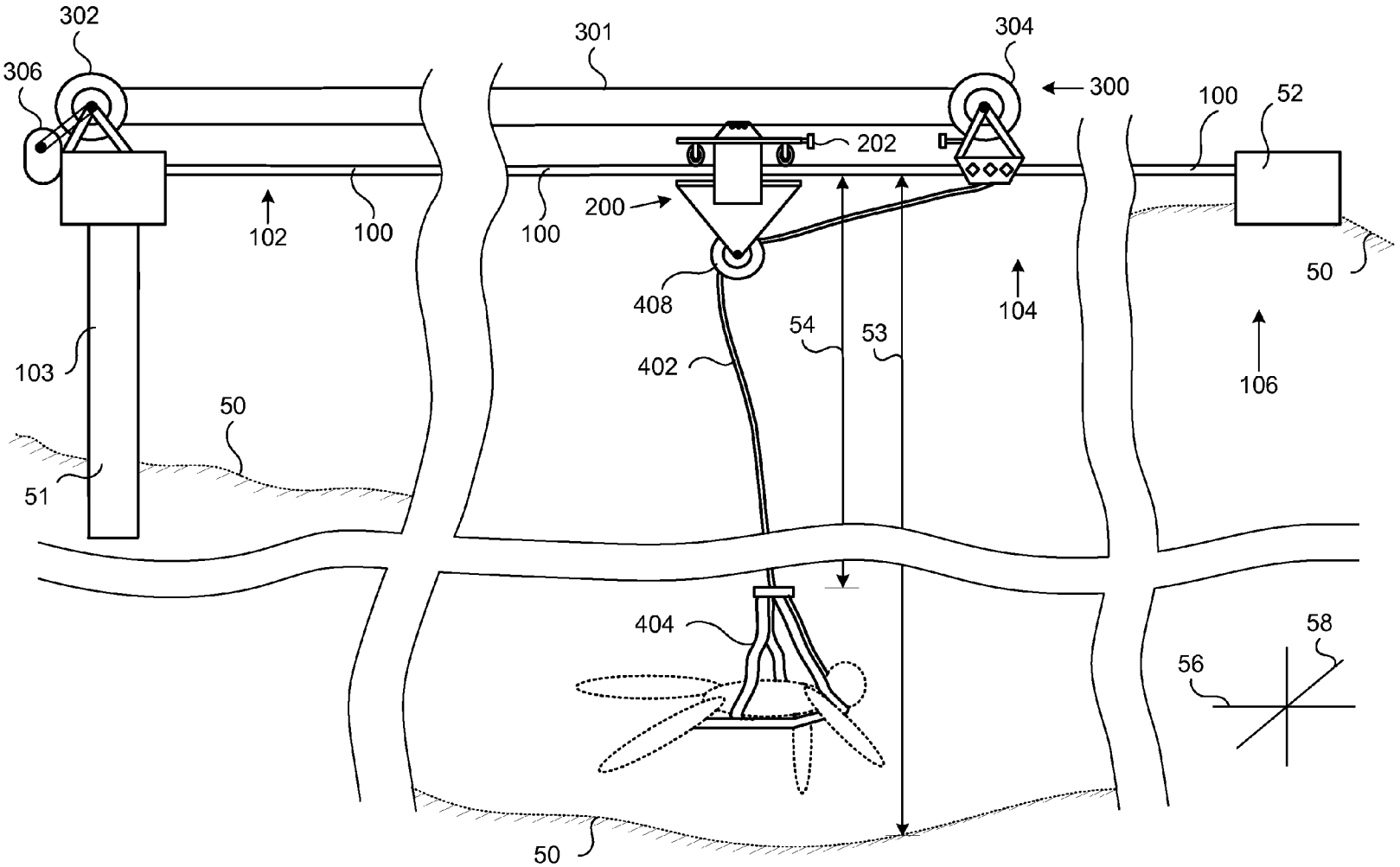
FIG. 5 depicts one embodiment of an amusement ride system for swinging a passenger on a swing line with the swing line affixed to a medial segment of a support component.

According to one embodiment, the swing line drive motor 406 may be configured to perform rapid retraction and extension actions, thus causing the length 54 of the swing line 402 to change throughout the swinging motion, thus increasing the thrill and amusement experience of the passenger. For example, the swing line drive motor 406 may be configured to raise and lower the passenger carriage 404 during the swinging trajectory in order to correspond to the various elevation contours of the canyon 50 floor. FIGS. 4 and 5 below include details relating to additional embodiments for configuring the swing subsystem 400.

Figure 3:
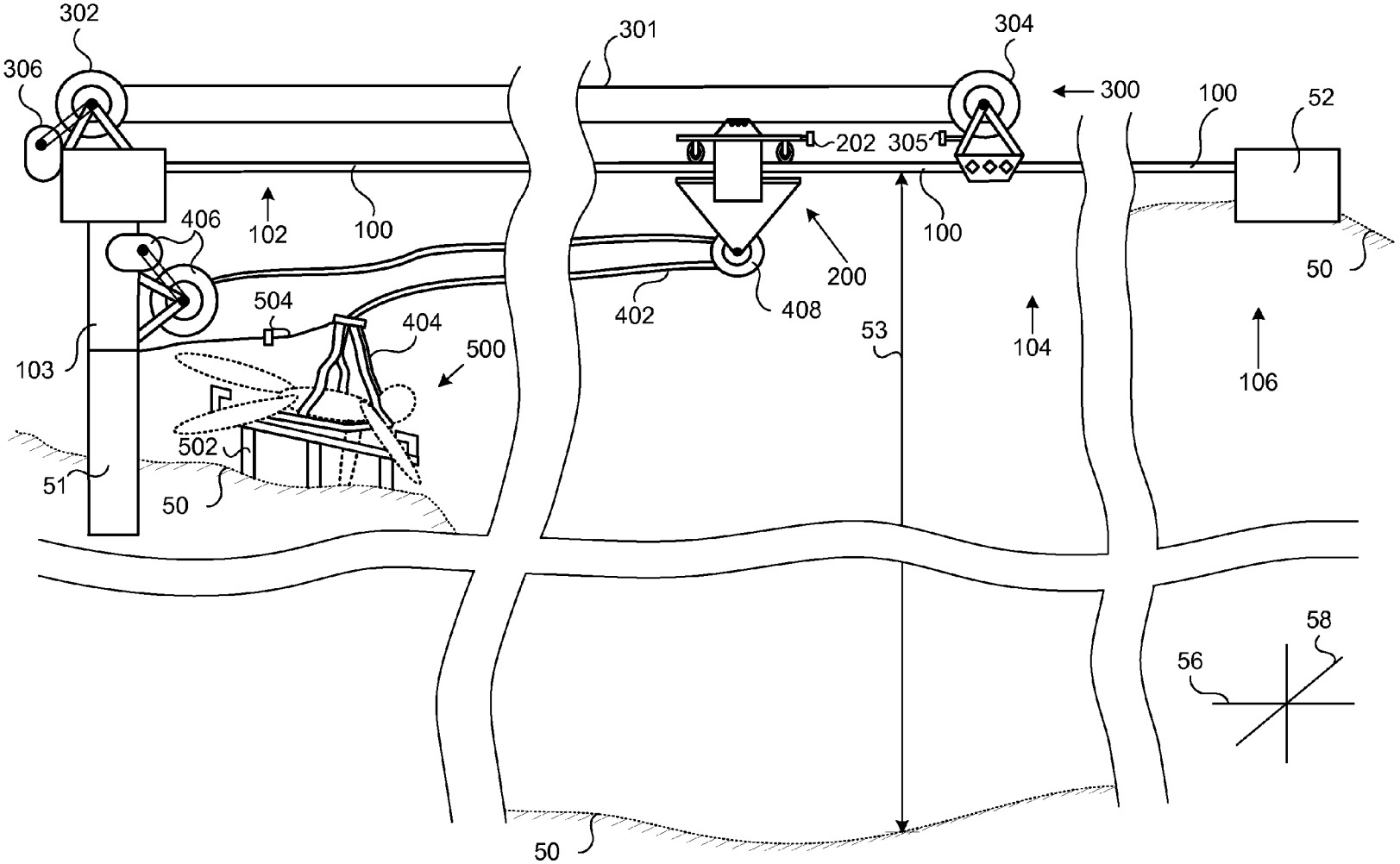
FIG. 3 depicts one embodiment of an amusement ride system for swinging a passenger on a swing line with the passenger in a loading position.

FIG. 3 depicts one embodiment of an amusement ride system for swinging a passenger on the swing line 402 with the passenger in a loading position. As briefly described above, the amusement ride system of the present disclosure may also include a passenger loading subsystem 500. The passenger loading subsystem 500 may include a platform 502 for temporarily engaging the passenger carriage 404 during loading/unloading and securing mechanisms 504 for temporarily anchoring the passenger carriage and/or the passenger during loading and unloading. For example, if the passenger carriage 404 is a board-like apparatus upon which a passenger lies, the platform 502 may include a frame for engaging the shape of the passenger carriage 404. According to one embodiment, the platform 502 may be configured to raise and lower to engage and disengage, respectively, the passenger carriage 404. Additionally, the platform 502 may also be configured to move and tilt in various directions in order to orient the passenger into a desired position before swinging. For example, once a passenger is loaded into the carriage 404, the platform 502 may tilt the carriage 404 so that the passenger is looking straight down the cliff face of the canyon 50. The securing mechanisms 504 may include supplementary anchoring lines that tether all passengers (and ride attendants) safely to the first point 51 or the first anchored segment 102. According to one embodiment, the securing mechanisms 504 may also be configured to serve as a rip cord or a pull string that the passenger may actuate in order to initialize the swing.

Using the embodiment depicted in FIG. 3, the amusement ride process for loading, swinging, and unloading passengers proceeds as follows, according to one example. First, the passenger is positioned into the passenger carriage 404 and the harnesses are securely fastened. The trolley 200 then, or concurrently, is moved along the support component 100 by the retraction subsystem 300 towards the medial segment 104 where it may be tethered (interaction between 202 and 305) to the medial pulley member 304, (or temporarily fixed to the support component 100 via an internal or integral clamping mechanism) in preparation for swinging, thus extending the swing line 402 to its swinging length. The platform 502 may tilt and/or rise, preparing the passenger and the passenger carriage 404 for launch. Once the passenger initiates the swinging action, either the trolley line drive motor 306 may be configured to move the trolley 200 closer to the medial segment 104 of the support component 100 or the swing line drive motor 406 may be configured to retract a portion of the swing line 402, thus ensuring that when the passenger carriage completes one pendulum period it will not make contact with the first point 51 (i.e., the canyon 50 wall) or the platform 502. After swinging, the retraction subsystem 300 moves the trolley 200 back towards the first anchored segment 102 and the platform 502 while the swing line drive motor 406 retracts the swing line 402 to raise the passenger carriage 404 up to the platform 502.

FIG. 4 depicts another embodiment of the amusement ride system for swinging a passenger on the swing line 402 with the swing line affixed to the trolley 200. In the depicted embodiment, the swing subsystem 400 only includes the swing line 402 and the passenger carriage 404. In other words, in the depicted embodiment, there is no swing line drive motor and no swing line pulley member. In such an embodiment, the passenger, while swinging, still pivots about the trolley 200 and the trolley is still movable along the length of the support component 100 between the first anchored segment 102 and the medial segment 104. However, since the swing line 402 does not retract, the depicted embodiment of the system may be implemented, for example, in situations where the passengers are loaded into the carriage 404 at a different location than where they are unloaded.

For example, passengers may be loaded into the carriage 404 at the first point 51 or at another elevated point along the wall of the canyon 50. After the passenger has swung on the ride and the swinging motion has substantially ceased, the trolley 200 may be configured to move back towards the first anchored segment 102 of the support component 100, thus allowing the passenger carriage 404 to come into contact with the side walls of the canyon 50 for unloading the passengers. The passenger carriage 404 may then be manually hoisted, by ride attendants or other users, back to the first point 51 for loading new passengers. Additionally, the retraction subsystem 300 may also be configured manually. In other words, ride attendants or other users may pull the trolley 200 back and forth along the support component 100 instead of using a drive motor. Thus, FIG. 4 depicts on embodiment of the swing system that includes fewer components but still provides the same basic architecture for providing passengers the thrill of swinging across a gap. In another embodiment, not depicted in FIG. 4, a swing line drive motor may be included in the swing subsystem 400 but the motor may be affixed to, or at least a component of, the trolley 200. In such an embodiment, the swing line 402 may be extended or retracted directly from the trolley 200.

FIG. 5 depicts yet another embodiment of the amusement ride system for swinging a passenger on the swing line 402 with the swing line 402 affixed to the medial segment 104 of the support component 100. In the depicted embodiment, the swing line 402 is anchored to the medial segment 104 of the support component 100, either directly or indirectly via the medial pulley member 304, and the swing subsystem 400 includes a swing line pulley member 408 affixed to the trolley 200 but does not include a swing line drive motor. In such an embodiment, the retraction subsystem 300 can move the trolley 200 back and forth along the support component 100 between the first anchored segment 102 and the medial segment 104, thus causing the passenger carriage 404 to raise and lower according to the position of the trolley 200.

For example, since the total length of the swing line 402 in the depicted embodiment is fixed, the length 54 of the swing line 402 between the support component 100 and the passenger carriage 404 increases as the trolley approaches the medial segment 104 and, conversely, the said length 54 decreases as the trolley approaches the first anchored segment 102. Therefore, in such an embodiment, a swing line drive motor may not be necessary because the retraction subsystem 300 and the movement of the trolley 200 raises and lowers the passenger carriage 404. However, although not depicted in FIG. 5, a passenger loading subsystem that movably extends outward and/or upward from the cliff 50, 51 may be helpful in such an embodiment to ensure the safety of the passengers and prevent the passenger carriage 404 from contacting the canyon during the swinging action. In another embodiment, not depicted in FIG. 5, a swing line drive motor may be included in the swing subsystem 400 but the motor may be affixed to the medial segment 104 of the support component 100 or to the medial pulley member 304.

Figure 6:
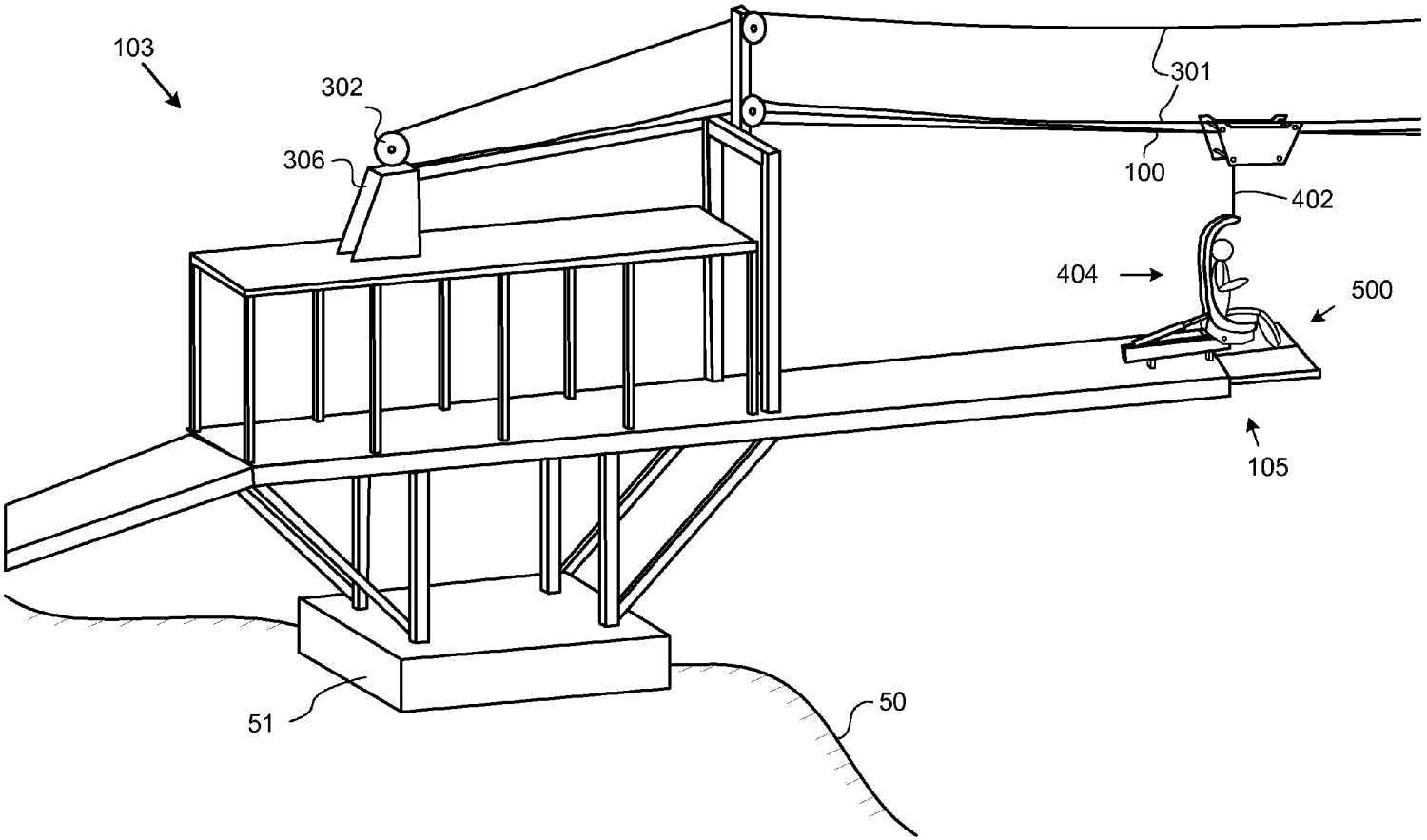
FIG. 6 depicts one embodiment of a tower and a platform for an amusement ride system.

FIG. 6 depicts one embodiment of a tower 103 and a passenger loading subsystem 500 for an amusement ride system. Similar to the embodiments described above, the embodiment of the tower 103 depicted in FIG. 6 not only provides an anchoring point for the various support cables and lines, but the tower 103 may also include walkways and various other passenger amenities. For example, the tower 103 may house the passenger loading subsystem 500. Although not shown in FIG. 6 to avoid obscuring aspects of the disclosure, the walkways may have safety walls or safety railings around the peripheral edges to prevent passengers and/or ride attendants from falling off. According to one embodiment, the trolley line drive motor 306 and the first pulley member 302 may be mounted to a roof of the platform 103 so that the trolley line 301 extends above the passengers (not depicted). The support component 100 may be affixed to the tower 103 at the same position as the trolley line drive motor 306. The tower 103 may also include cable winches (not shown) for tensioning the support component cables. At one end 105 of the tower 103, a walkway may extend out over the edge of the canyon 50 wall. A passenger loading subsystem 500 may be located at the end 105 of the walkway. Also depicted in FIG. 6 is a swing line 402 and a passenger carriage 404. Additional details regarding one embodiment of the passenger loading subsystem 500 and the passenger carriage 404 are shown in FIGS. 7 and 8.

Figure 7:
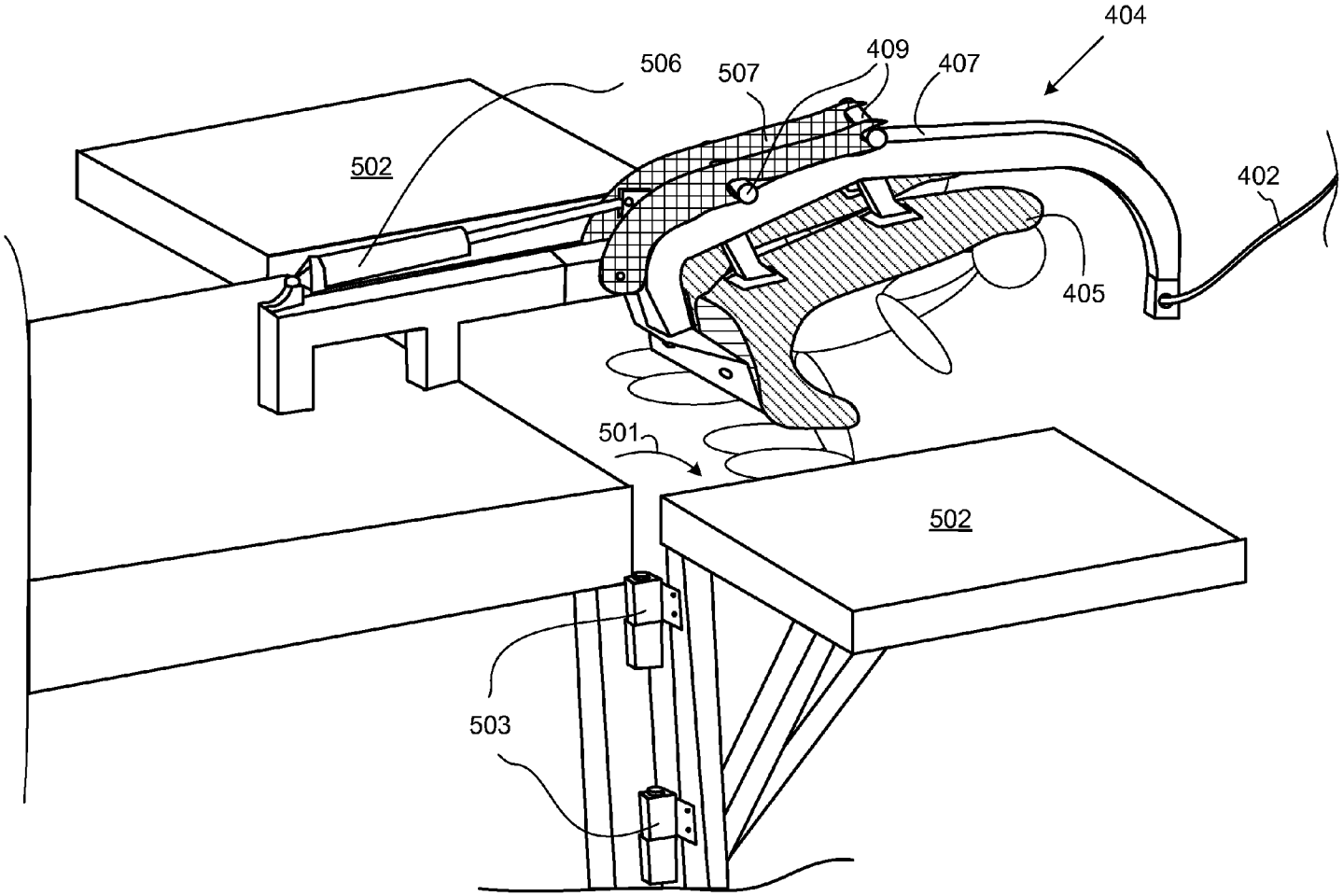
FIG. 7 depicts one embodiment of a platform with a passenger carriage in a launching position.

FIG. 7 depicts one embodiment of a platform 502 of a passenger loading subsystem 500 with a passenger carriage 404 in a launching position. According to one embodiment, the platform 502 of the loading subsystem 500 may include rotatable floor panels that pivot 501 outwardly about hinges 503 into a launch position. The passenger loading subsystem 500 may also include an actuating lift 506 (e.g., a hydraulic/pneumatic piston) that can be controlled to position the carriage 404 in the launch position, as depicted. In other words, once a passenger is securely harnessed into the passenger carriage 404, the floor panels below him may pivot outwards and the carriage 404 may be tipped forward by the actuation of the lift 506 so that the passenger is looking straight down at the canyon 50 and the ground below. As described above, the passenger may then pull or trigger the release of the securing mechanism to initiate the swing. In another embodiment, the passenger loading subsystem may automatically trigger the release of the passenger carriage 404. According to another embodiment, and as described below in greater detail with reference to FIG. 8, the passenger loading subsystem 500 may have engagement arms 507 that have notches 508 (not shown in FIG. 7, see FIG. 8) for receiving support bars 409 affixed to the support member 407 of the passenger carriage 404. As the passenger carriage 404 is tilted forward by the lift 506, the support bars 409 may slide out of the notches 508 of the engagement arms 507 to commence the swinging action.

Figure 8:
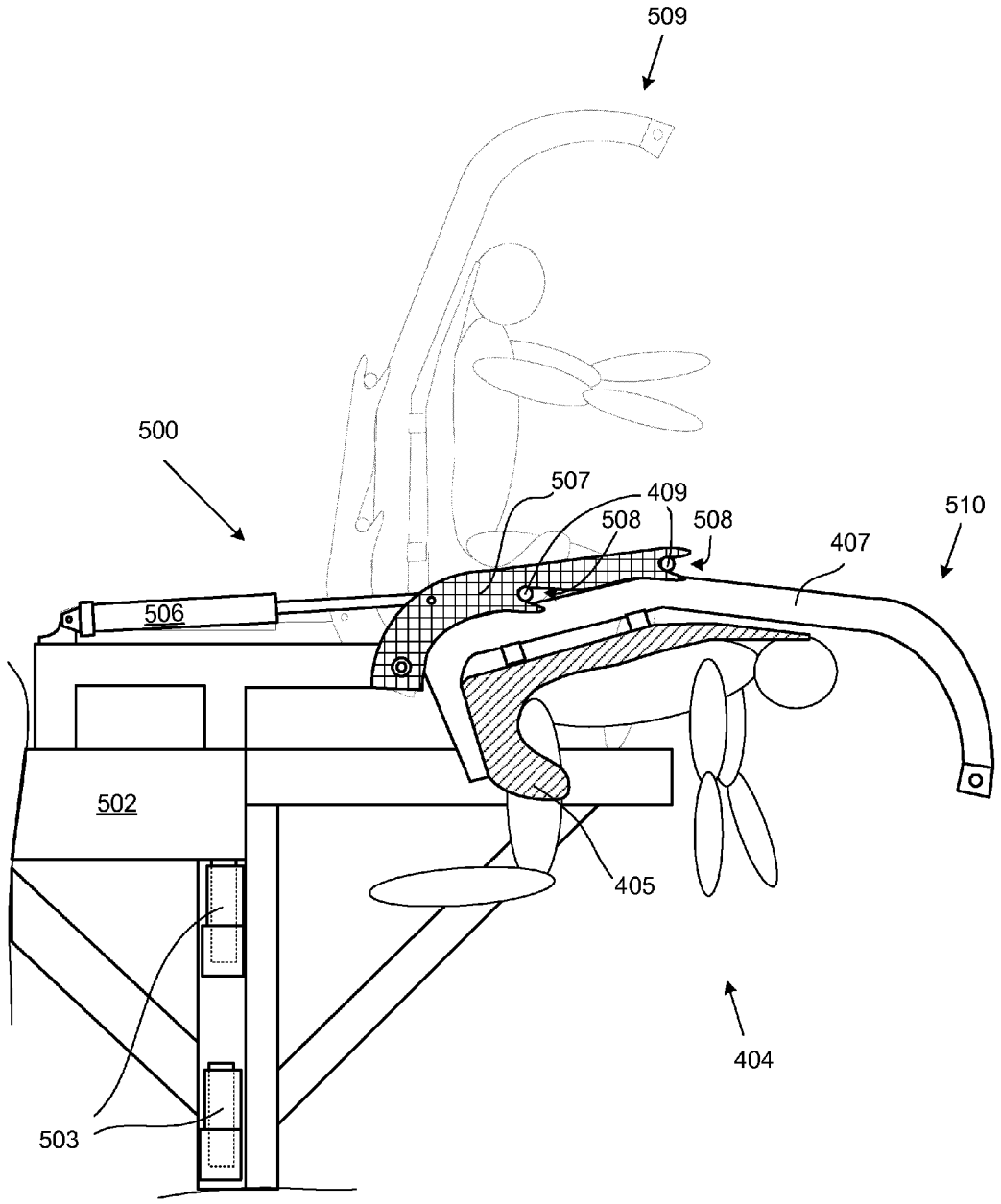
FIG. 8 depicts one embodiment of a passenger loading subsystem.

FIG. 8 is a side view of one embodiment of a passenger loading subsystem 500 and a passenger carriage 404. FIG. 8 depicts the passenger loading subsystem 500 and the passenger carriage 404 in both a loading position 509 (gray-dotted lines) and a launch position 510. The passenger carriage 404 may include a passenger seat 405 permanently affixed to a passenger support member 407. As briefly described above, the passenger seat 405 may hold a single passenger or may hold multiple passengers (e.g., a tandem seat). The passenger support member 407 may have support bars 409 that extend horizontally across the support member 407. These support bars 409 may be received into notches 508 on the engagement arms 507. Once again, the engagement arms 507 are hingedly coupled to a fixed point on the platform and the lift 506 can be actuated to extend and retract the loading subsystem 500 between the loading position 509 and the launch position 510. Once the lift 506 has tipped the engagement arms 507 to a certain position, the support bars 407 of the passenger carriage 404 may slide out of the notches 508 on the engagement arms 507 and the passenger carriage 404, including the passenger support member 407, the passenger seat 405, and the passenger, commences the swinging action.

It is contemplated that additional configurations of the various components and subsystems of the amusement ride swing system fall within the scope of the present disclosure. For example, the swing line drive motor 406 may be positioned and affixed to various locations in the system or may not even be included at all in a certain embodiment, as briefly described above. Additionally, it is contemplated that the components and subsystems of the presently disclosed amusement ride swing system are scalable according to the needs of a specific application. For example, multiple support components (e.g., multiple cables) 100 may extend across the canyon 50 (at least the multiple cables would extend between the first anchored segment 102 and the medial segment 104) for supporting multiple trolleys 200, multiple retraction subsystems 300, multiple swing subsystems 400, and/or multiple loading subsystems 500 for expeditiously ushering passengers through the ride.

Figure 9:
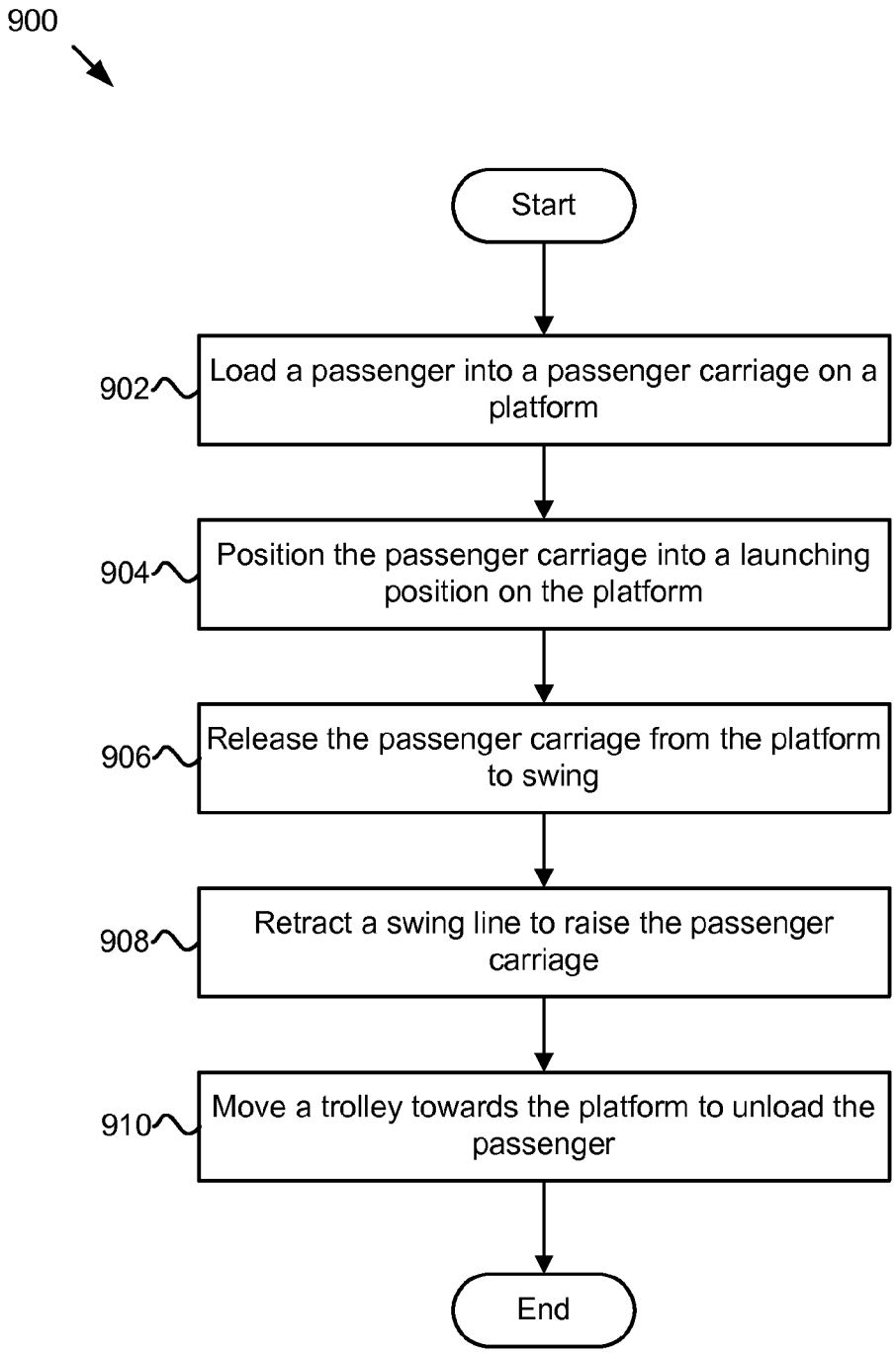
FIG. 9 is a schematic flow chart diagram of a swing amusement ride method, according to one embodiment.

FIG. 9 is a schematic flow chart diagram of a swing amusement ride method 800, according to one embodiment. The method 900 includes loading a passenger into a passenger carriage on a platform at 902. A swing line is interconnected between the passenger carriage 404 and the trolley 200. The trolley 200 is movably attached to the support component 100 that extends in a direction across a canyon 50. The method 900 includes positioning the passenger carriage into a launching position on the platform at 904. The method 900 continues and the passenger carriage is released from the platform to swing in the direction of the support component at 906. After the swinging ride has stopped, the method 900 includes retracting the swing line to raise the passenger carriage at 909 and moving the trolley towards the platform to unload the passenger from the passenger carriage at 910.

Figure 10:
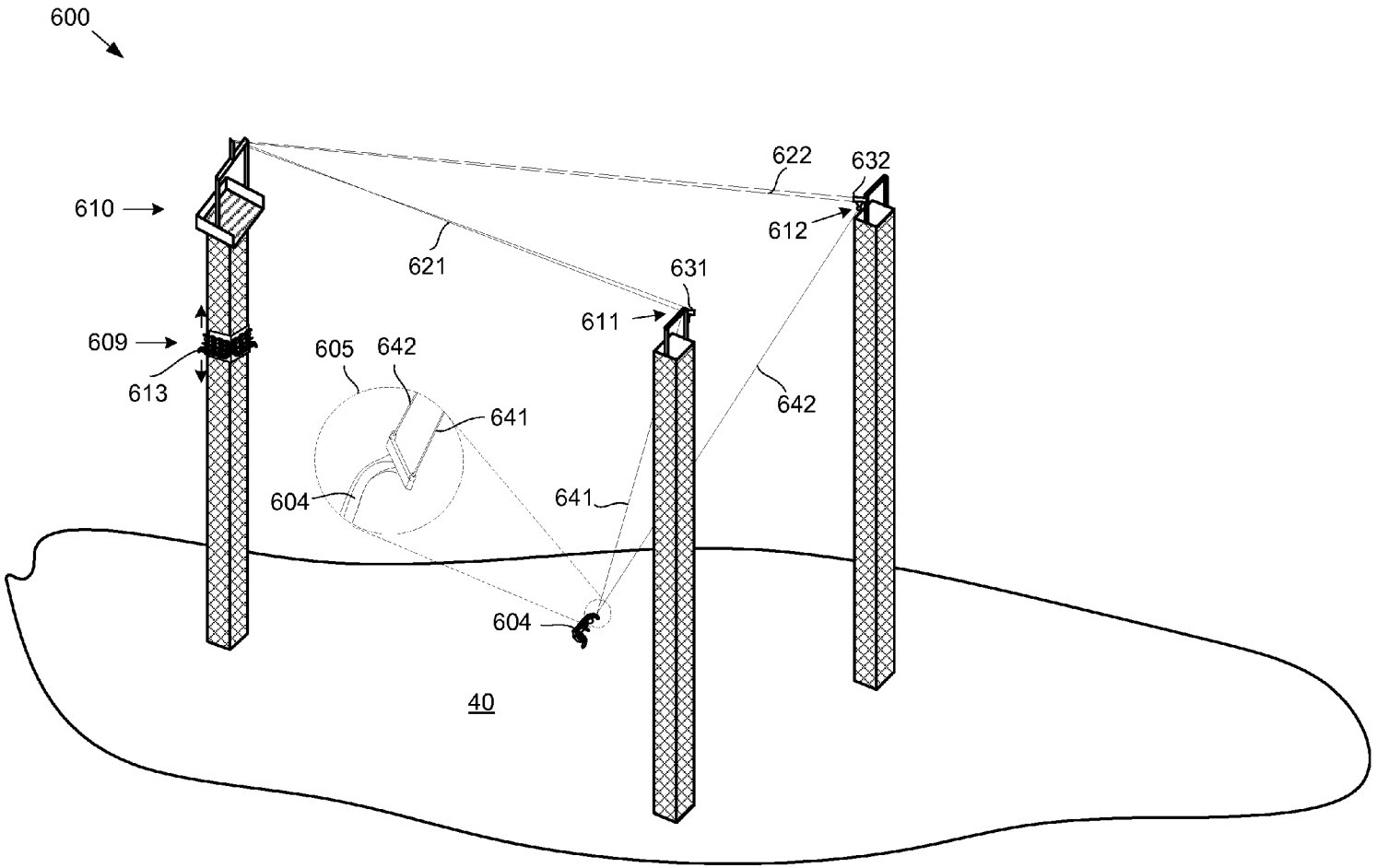
FIG. 10 depicts one embodiment of an amusement ride system for swinging a passenger carriage on a first and second swing line between a first and second location.

FIG. 10 depicts one embodiment of an amusement ride system 600 for swinging a passenger carriage 604 on a first swing line 641 and second swing line 642. The first swing line 641 extends from and swings about a first location 611 and the second swing line 642 extends from and swings about a second location 612. The first location 611 and second location 612 are spaced apart from each other. FIG. 10 also depicts a magnified view of the first and second swing lines 641, 642 coupled to the passenger carriage 604.

In the depicted embodiment, the loading location 610, the first location 611, and the second location 612 are all substantially elevated above the ground 40. As seen, the loading location 610, the first location 611, and the second location 612 may be coupled to or portions of separate, man-made towers. In one embodiment, one or more of the locations 610, 611, 612 is a tower that is utilized for a separate amusement ride 609 that may function as part of the passenger loading subsystem. For example, the loading location 610 may be coupled to or may be a portion of rapid-rise/rapid-fall type ride 609. The ride 609 may include a passenger carriage 613 movably secured about the tower. The passenger carriage 613 retains one or more passengers, such as in a seated position. Further, the passenger carriage 613 is driven upwardly and downwardly along the tower as shown by directional arrows via a power source or mechanism (not shown). The power source is configured to cause the passenger carriage to rapidly ascend and/or rapidly descend translationally along the tower. In certain implementations, passengers are loaded onto the passenger carriage 613 at a first loading location on the ground. The passenger carriage 613 rapidly rises and falls, and ultimately stops at a second loading proximate the top of the tower above the ground. The passengers then unload from the passenger carriage 613, and then load into the passenger carriage 604. After experiencing the ride on the passenger carriage 604, the passengers then unload from the passenger carriage 604, and load into the passenger carriage 613, which descends to the first loading to allow the passengers to return to the ground. In this manner, a passenger may experience two different types of rides as one continuous experience, with one ride functioning as part of the loading subsystem of the other ride.

In another embodiment, one or more of the locations 610, 611, 612 may be coupled to or portions of a natural structure, such as the wall of a canyon. In yet another embodiment, two or more of the locations 610, 611, 612 may be interconnected to have an integrated structure. For example, the first and second locations 611, 612 may be integrated together in an arch structure that allows the passenger carriage 604 to swing between the support legs of the arch structure. As depicted, and according to one embodiment, the locations 610, 611, 612 are arranged in a triangular formation, such that lines drawn from location to location form a triangle. In one embodiment, the loading location 610 is similar to the first anchored segment 102 of the support component 100 described above. Further, the loading location 610 may be similar to and include components of the passenger loading subsystem 500 described above with reference to FIGS. 6-8.

The two swing lines 641, 642 are each pivotally engaged on a respective one of two trolleys 631, 632. Respective ends of both swing lines 641, 642 are coupled to the passenger carriage 604 in a spaced-apart manner. With two spaced-apart swing lines 641, 642 supporting the passenger carriage 604, the passenger carriage 604 can be more easily maintained in a desired rotational orientation and lateral position during the swinging motion, compared to supporting the passenger carriage with a single swing line. For example, the two swing lines 641, 642 cooperatively function to substantially maintain the rotational orientation of the passenger carriage 604 in a forward facing direction and substantially maintain the lateral position of the passenger carriage along a single vertical-longitudinal plane. Further, the two spaced-apart swing lines 641, 642 of the system facilitate a decrease in loading/unloading cycle times by increasing the stability of the carriage during a retraction operation of the swing lines. As will be described in more detail below, the retraction operation includes the retraction, or shortening, of the portions of the swing lines 641, 642 extending from the trolleys 631, 632 to the passenger carriage 604.

The trolleys 631, 632 of the amusement ride system 600 are movably attached to a respective one of two anchor cables 621, 622. A first anchor cable 611 extends between the loading location 610 and the first location 611, and a second anchor cable 612 extends between the loading location 610 and the second location 612. Each of the anchor cables 621, 622 may have properties similar to the support component 100 described above. The amusement ride system 600 further includes one or more trolley actuation subsystems (not depicted in FIG. 10) coupled to the trolleys 631, 632. The trolley actuation subsystem is similar to the retraction subsystem described above. The trolley actuation subsystems are controllable to move the trolleys back and forth along the anchor cables 611, 612. Further details relating to the trolley actuation subsystem(s) are included below with reference to FIGS. 11A and 11B.

The anchoring points of the swing lines 641, 642, the inclusion of a swing line drive motor (not depicted in FIG. 10), and the implementation details of the retraction subsystems may be selected according to the specifics of a given application. For example, the first swing line 641 and the second swing line 642 may be affixed to the loading location 610 and pivotally engaged on pulley members of the trolleys 631, 632, in a manner similar to the embodiment described above in FIG. 2. In such an embodiment, the loading location 610 may include swing line drive motors for extending and retracting a respective one of the swing lines 641, 642. In another embodiment, the swing lines 641, 642 may be directly affixed to the trolleys 631, 632, respectively, similar to the configuration of FIG. 4. In yet a further embodiment, the swing lines 641, 642, may be affixed to the first and second locations 611, 612, respectively, similar to the configuration described above with reference to FIG. 5. Those of ordinary skill in the art will recognize, in view of this disclosure, other various configurations and positions of the swing line components and the retraction subsystem components that may be implemented according to the specifics of a given application. Such configurations and positions fall within the scope of the present disclosure. In one embodiment, the amusement ride system 600 includes a swing line tension subsystem 650 as described below with reference to FIG. 12. In another embodiment, the amusement ride system 600 operates according to the method described below with reference to FIG. 13.

Figure 11A:
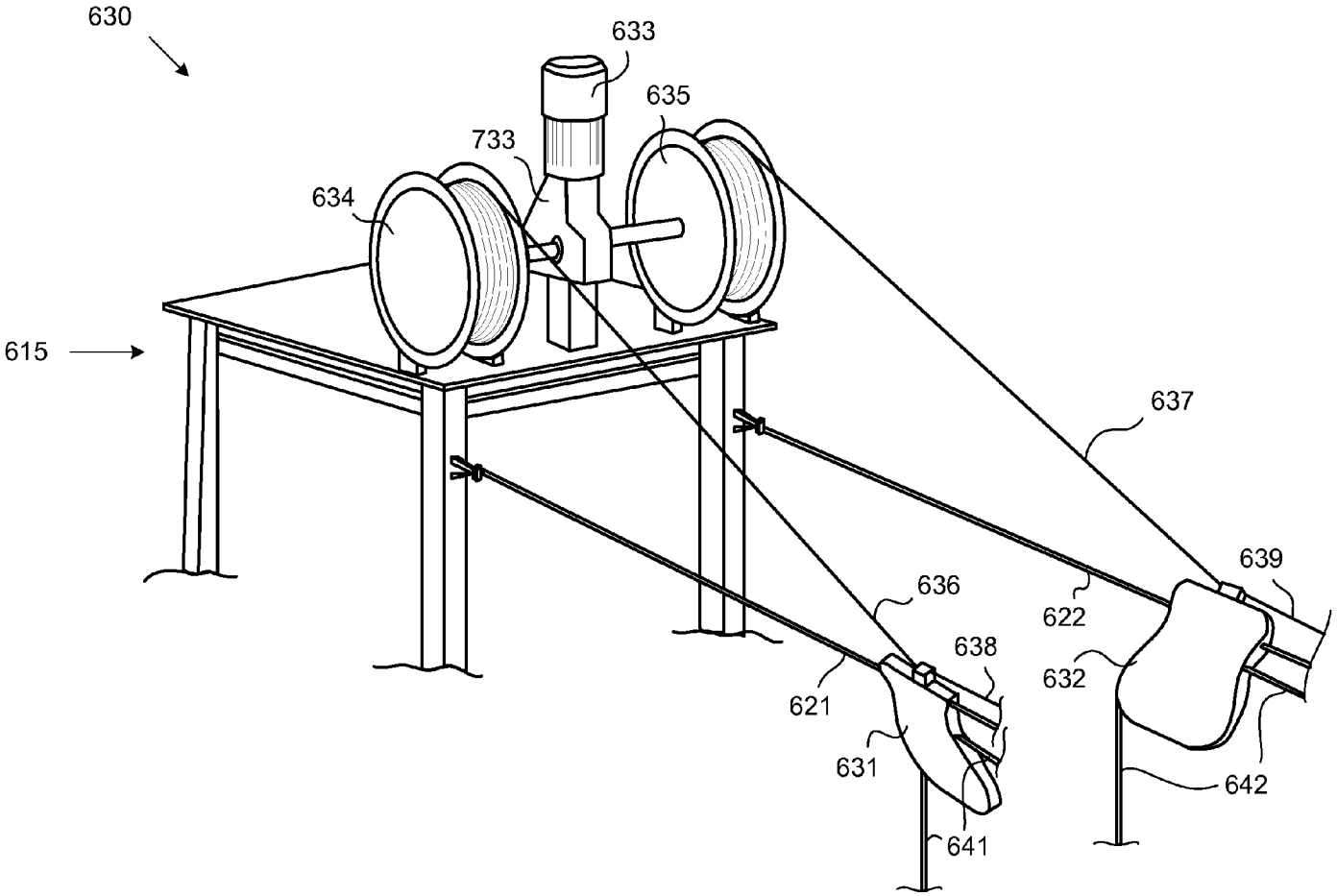
FIG. 11A depicts one embodiment of a trolley retraction subsystem that shows a trolley line motor mounted to an anchoring structure.

FIG. 11A depicts one embodiment of a trolley actuation subsystem 630 that shows a trolley line motor 633 mounted to an anchoring structure 615. In the depicted embodiment, the trolley actuation subsystem 630 includes a single trolley line motor 633 that is operably coupled to a first trolley sheave 634 and a second trolley sheave 635. The first and second trolley sheaves 634, 635 are configured to controllably retract and extend a first trolley line 636 and a second trolley line 637, respectively. The first trolley line 636 is coupled to the first trolley 631 and the second trolley line 637 is coupled to the second trolley 632. By utilizing a single trolley line motor 633 in this manner to retract and extend both trolley lines 636, 637, both trolleys 631, 632 are evenly and uniformly pulled back towards the loading location (see, e.g., 610 in FIG. 10) and extended away from the loading location, thus maintaining the passenger carriage 604 in a desired orientation. As depicted, the trolley line drive motor 633 may also include a gearbox 733 for controlling the speed of retraction. Additionally, as described in greater detail below, the gearbox 733 may also disengage the sheaves 634, 635 from the trolley line drive motor 633, thus allowing the trolleys 631, 632, whether by gravity or by an active system, to move back across the anchor cables 621, 622 towards the first and second locations 611, 612.

As described above, the mounting structure 615 may be coupled to or may be a portion of the loading location 610. For example, as described above with reference to FIGS. 6 and 10, the first location 610 may include a man-made platform for loading and unloading passengers. The mounting structure 615 may be coupled above or may form a raised portion of the loading platform, thus allowing the trolleys 631, 632 to move over the platform and situate the carriage 604 into the loading position.

The trolley lines 636, 637 may be, for example, 0.25-inch cables extending between the respective trolley sheaves 634, 635 and the respective trolleys 631, 632. In another embodiment, the trolley lines 636, 637 may be made from belts or straps. The trolley sheaves 634, 635 may include drums, pulleys, or barrels for engaging the respective lines. In one embodiment, the sheaves 634, 635 may be grooved with a plurality of grooves such that each groove of a sheave receives a respective length of a trolley line when the line is wound onto the sheave. In this manner, a trolley line is not wound on top of, or overlap, itself, but rather is evenly and controllably positioned in sections adjacent each other along an axis of the sheath. FIG. 11A also shows a first weighted line 638 and a second weighted line 639 coupled to the first and second trolleys 631, 632, respectively. These weighted lines 638, 639 are described in greater detail below with reference to FIG. 11B.

Figure 11B:
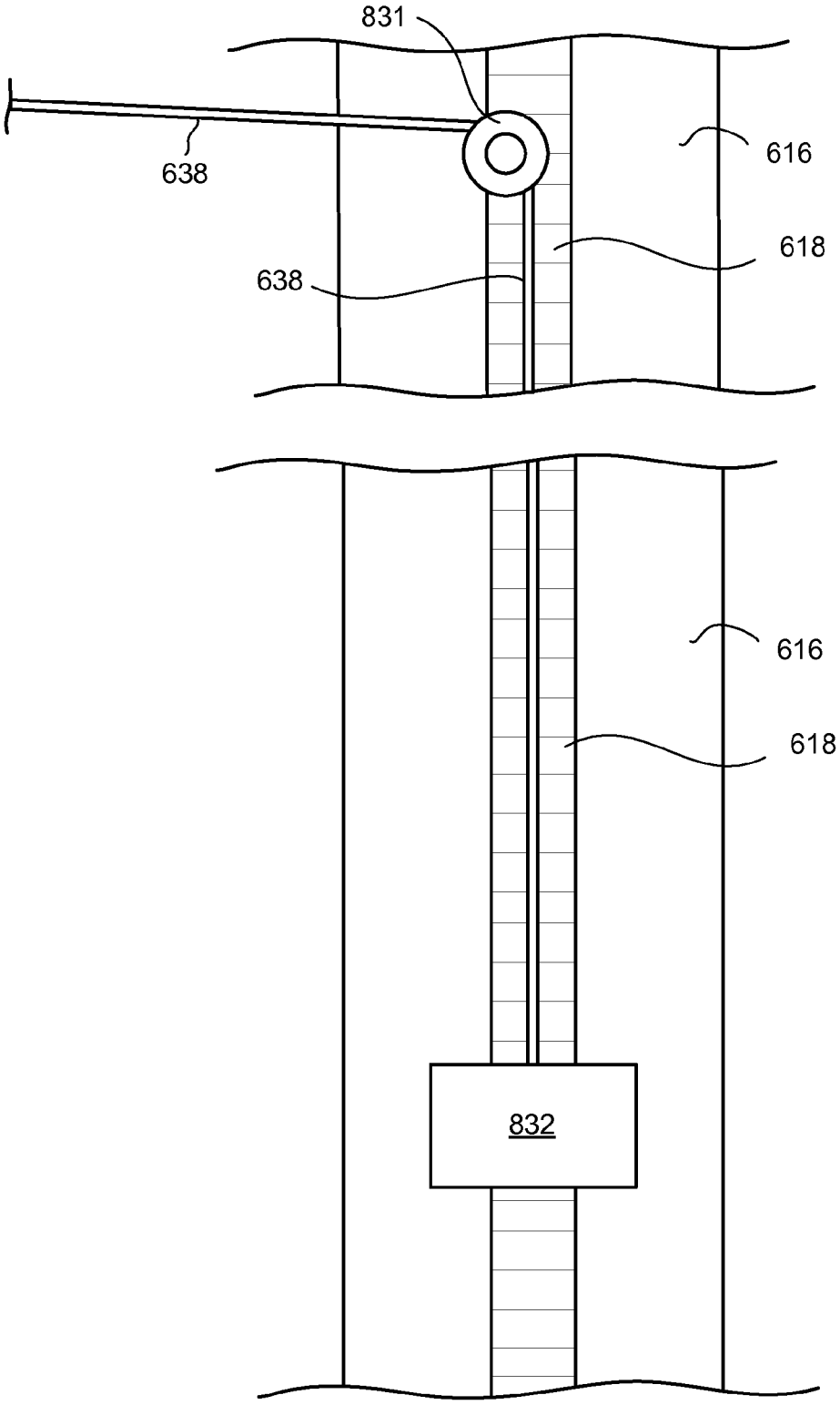
FIG. 11B depicts one embodiment of a trolley actuation subsystem that shows a first weighted line coupled to a weight for pulling the first trolley to the first location in preparation for a swinging ride.

FIG. 11B depicts one embodiment of a trolley actuation subsystem 630 that shows a first weighted line 638 coupled to a weight 832 for pulling the first trolley 631 to the first location 611 in preparation for the swinging ride. On one end, the first weighted line 638 is coupled to the first trolley 631, and on the other end, the first weighted line 638 may be coupled to a weight 832. The weight 832 may operably move along a vertical track 618 that is integrated with the first tower 618 (i.e., first location 611). The vertical track 618 allows the weight 832 to move up and down the tower 616 in a controlled fashion and prevents the weighted line 638 from getting tangled with itself and/or other components of the tower.

As described above, the trolley actuation subsystem 630 includes a trolley line drive motor 633 for pulling the trolleys back towards the loading location 610. One or more weights may be used to pull the trolleys 631, 632 back to the swinging position adjacent the respective locations 611, 612. In such an embodiment, the trolley line drive motor 633 may disengage (via a clutch or other assembly), thus allowing the weight 832 to pull the first trolley 631 back towards the first location 611. It is expected that a similar configuration may be implemented with respect to the second trolley and the second location. In another embodiment, a single weight may be utilized to pull both trolleys back to the first and second locations, with cables and sheaves routed accordingly. In another embodiment, a drive motor, instead of a weight, may be implemented to pull the trolleys away from the loading location.

Figure 12:
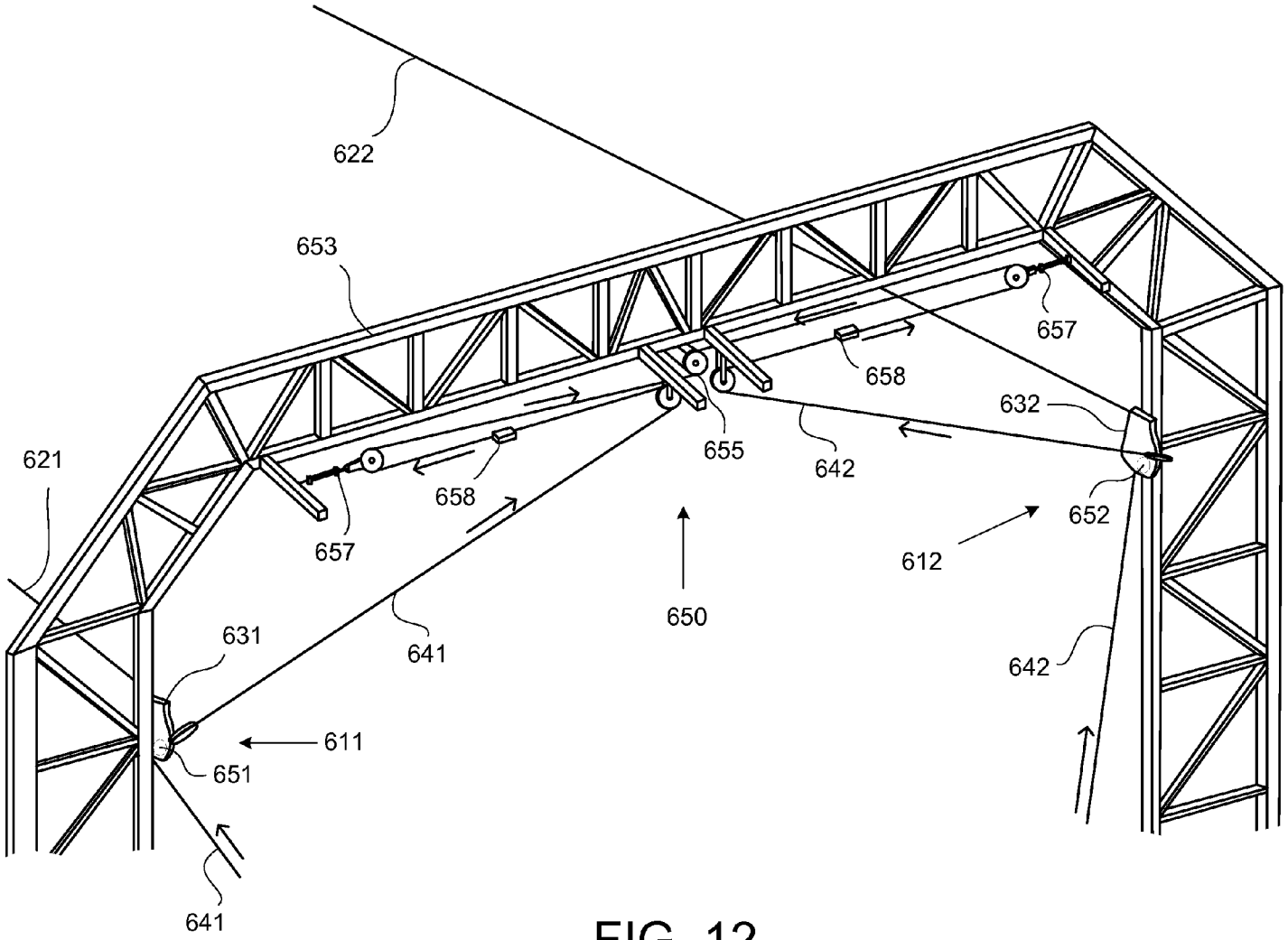
FIG. 12 depicts one embodiment of a swing line tension subsystem that controls slack and tension in a first swing line and a second swing line.

FIG. 12 depicts one embodiment of a swing line tension subsystem 650 that controls slack and tension in first and second swing lines 641, 642. FIG. 12 is cross-sectional view of an integrated tower structure 653 that includes both the first location 611 and the second location 612. The first and second trolleys 631, 632 are shown movably supported on first and second anchor cables 621, 622. For clarity, components of the trolley actuation subsystems, which are similar to the retraction subsystem described above (including trolley lines, trolley pulleys, and trolley drive motors) for each trolley 631, 632 are not shown in FIG. 12.

The first and second swing lines 641, 642 are secured to the swing line tension subsystem 650, which is coupled to the tower structure 653. In one implementation, the swing line tension subsystem 650 is coupled to a cross-member of the tower structure 653 that interconnects two vertical towers. The swing line tension subsystem 650 includes various pulleys/sheaves for routing the swing lines 641, 642 to the swing line drive motor 655. In one embodiment, the swing lines 641, 642 are each pivotally engaged on sheaves 651, 652 within each trolley 631, 632, similar to the configuration shown in FIGS. 5 and 11. In such a configuration, as the trolleys 631, 632 are pulled back towards the loading location 610 (not depicted in FIG. 12), the portions of the swing lines 641, 642 between the trolleys 631, 632, respectively, and the passenger carriage 604 are shortened, thereby effectively raising the passenger carriage 604 to an elevated position for loading/unloading passengers at the loading location 610.

The swing line tension subsystem 650 may include a single swing line drive motor 655 that retracts and extends both swing lines 641, 642. The swing line drive motor 655 can be actuated (e.g., rotated) to cause the first and second swing lines 641, 642 to move in the direction indicated by the movement arrows for retracting the swing lines 641, 642. The drive motor 655 may be further actuated to operate in a reverse direction (e.g., a direction opposite the direction indicated by the movement arrows), thereby extending the swing lines 641, 642. According to one embodiment, the drive motor 655 may be used to extend and retract substantial portions of the swing lines 641, 642 to facilitate elevating the passenger carriage for loading/unloading 604. However, in the depicted embodiment, the swing line tension subsystem 650 may only provide a small degree (e.g., several feet) of extension/retraction of the swing lines 641, 642.

As described above, the movement of the trolleys 631, 632 along the anchor cables 621, 622 and the sheave engagement between the swing lines 641, 642 and the trolleys 631, 632 may, to a major extent, facilitate the raising and lowering of the passenger carriage 604, while the swing line tension subsystem 650 only minimally contributes to the raising and lowering of the passenger carriage 604. For example, as the trolleys 631, 632 are pulled back towards the loading location 610, the portion of the swing lines 641, 642 between the trolleys 631, 632 is shortened so that the passenger carriage 604 is drawn upwards toward and proximate the trolleys 631, 632, as well as the loading location 610. However, a small degree of slack in the swing lines 641, 642 may be useful in order to easily perform the load/unload operations. In such an embodiment, the swing line tension subsystem 650 may be employed to provide the small degree of flexibility to the swing line length. Further, upon loading and preparing passengers for the ride, the swing line tension subsystem 650 may then be operatively controlled to take up the slack in the swing lines 641, 642, thus allowing a passenger to experience a smooth swinging motion (i.e., preventing the passengers from experiencing the sudden acceleration jolt that would occur if the swing lines had slack). In another embodiment, the swing line tension subsystem 650 may further include shock absorber elements 657 that further allow the user to experience a smooth ride.

The swing line tension subsystem 650 may further include safety mechanisms, such as blocks or knots 658 affixed to the portion of the swing lines between two pulley members that would catch and prevent the passenger carriage 604 from falling in the event that the swing line drive motor 655 fails. Further, the swing line tension subsystem 650 may include guide panels or protective panels running along the routed swing lines 641, 642 to prevent undesired twisting/tangling of the swing lines 641, 642. In one embodiment, the swing line tension subsystem may not be mounted to the tower structure 653 between the first and second locations 611, 612 but instead may be mounted to one of the locations 611, 612 and may include pulleys and sheaves that route the tension lines and/or shock absorber elements to the other location. In another embodiment, instead of using a single drive motor 655, two drive motors may be employed, such as one for each swing line. For example, the swing line tension subsystem may include two separate assemblies on each of the first and second locations 611, 612 (i.e., towers).

Figure 13:
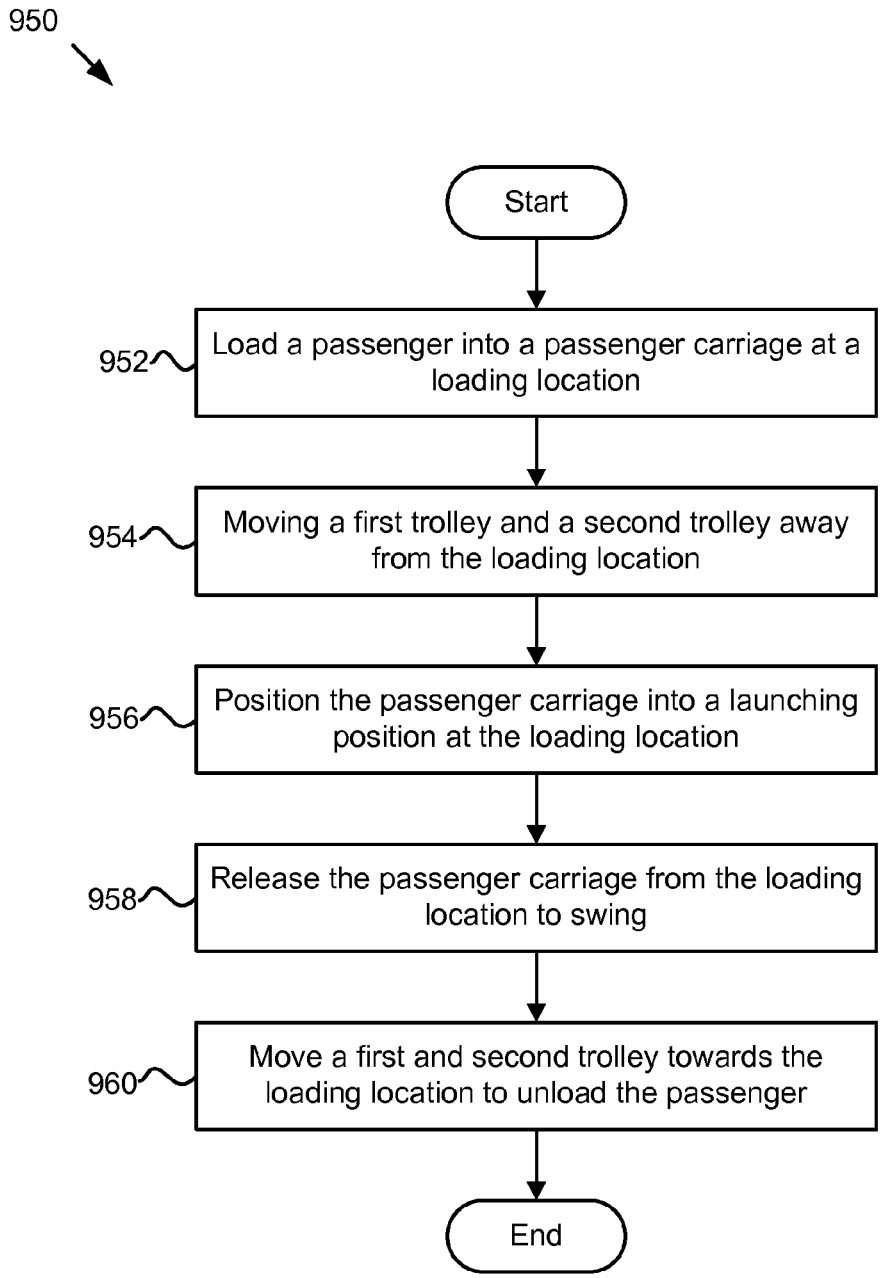
FIG. 13 is a schematic flow chart diagram of swing amusement ride method, according to one embodiment.

FIG. 13 is a schematic flow chart diagram of a swing amusement ride method 950, according to one embodiment. The method includes loading a passenger into a passenger carriage at a loading location (e.g., the loading location 610) at 952. A first swing line and a second swing line of the swing amusement ride are interconnected between the passenger carriage and first and second trolleys, respectively. As described above, the first trolley and the second trolley can be movably attached to a first anchor cable and a second anchor cable, respectively. The method 900 further includes moving the first trolley and the second trolley away from the loading location at 954 and positioning the passenger carriage into a launching position at the loading location at 956. Positioning the passenger carriage may include using a swing line tension subsystem (e.g., the swing line tension subsystem 650 of FIG. 12) to adjust the tension and/or slack of the swing lines. The method 950 also includes releasing the passenger carriage from the loading location to swing at 958 and, once the ride is over, moving the trolleys towards the loading location to unload the passenger(s) from the passenger carriage at 958. Once again, moving the trolleys towards the loading location may include using the swing line tension subsystem to adjust the tension and/or slack of the swing lines.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An amusement ride system, comprising:

a support subsystem comprising a loading location, a first location, and a second location, each elevated a distance above the ground, wherein the support subsystem further comprises a first anchor cable extending between the loading location and the first location and a second anchor cable extending between the loading location and the second location;

a first trolley movably attached to the first anchor cable;

a second trolley movably attached to the second anchor cable;

a trolley actuation subsystem that moves the first trolley and the second trolley along a length of the first anchor cable and the second anchor, respectively, wherein the first trolley and the second trolley move in a parallel manner in the same general direction;

a swing subsystem comprising a passenger carriage, a first swing line coupled to the passenger carriage and pivotally engaged with the first trolley, and a second swing line coupled to the passenger carriage and pivotally engaged with the second trolley; and a swing line tension subsystem to which the first swing line and the second swing line are anchored, wherein the swing line tension subsystem controls slack and tension in the first swing line and the second swing line.

2. The amusement ride system of claim 1, wherein the trolley actuation subsystem comprises a single trolley line drive motor for retracting both the first trolley and the second trolley.

3. The amusement ride system of claim 1, wherein the passenger carriage is a first passenger carriage, the amusement ride further comprising a passenger loading subsystem, the passenger loading subsystem comprising a tower and a second passenger carriage movably coupled to the tower that at least one of rapidly ascends and rapidly descends translationally along the tower to position a passenger proximate the first passenger carriage.

4. The amusement ride system of claim 1, further comprising a passenger loading subsystem, the passenger loading subsystem comprising a platform and a securing mechanism, wherein the platform temporarily engages the passenger carriage while loading and unloading passengers, and the securing mechanism temporarily secures the passenger carriage while loading and unloading passengers.

5. The amusement ride system of claim 4, wherein the platform comprises moveable floor panels that can be retracted or rotated to a launch position.

6. The amusement ride system of claim 5, wherein the passenger carriage can be positioned so that passengers look substantially straight down to the ground when the floor panels are retracted or rotated to the launch position.

7. The amusement ride system of claim 1, wherein the swing subsystem further comprises a swing line drive motor for extending and retracting the first swing line and the second swing line.

8. The amusement ride system of claim 1, wherein the swing line tension subsystem comprises a swing line drive motor for extending and retracting the first swing line and the second swing line.

9. The amusement ride system of claim 1, wherein the swing line tension subsystem comprises shock absorber elements.

10. The amusement ride system of claim 1, wherein the first anchor cable and the second cable each comprise two cables tensioned to 5,000 pounds.

11. The amusement ride system of claim 1, wherein the passenger carriage comprises a seat for positioning a passenger in a seated position.

12. The amusement ride system of claim 11, wherein the seat is a tandem seat for positioning two passengers side-by-side in the seating position.

13. An amusement ride system, comprising:

a support subsystem comprising a loading location, a first location, and a second location that are all elevated a distance above the ground, wherein the support subsystem further comprises a first anchor cable extending between the loading location and the first location and a second anchor cable extending between the loading location and the second location;

a first trolley movably attached to the first anchor cable;

a second trolley movably attached to the second anchor cable;

a trolley actuation subsystem that moves the first trolley and the second trolley along the length of the first anchor cable and the second anchor, respectively, wherein the first trolley and the second trolley move in a parallel manner in the same general direction;

a swing subsystem comprising a passenger carriage, a first swing line coupled to the passenger carriage and pivotally engaged to the first trolley, and a second swing line coupled to the passenger carriage and pivotally engaged to the second trolley;

a swing line tension subsystem to which the first swing line and the second swing line are anchored, wherein the swing line tension subsystem controls slack and tension in the first swing line and the second swing line; and a passenger loading subsystem comprising a platform and a securing mechanism, wherein the platform temporarily supports passengers and ride attendants while loading and unloading passengers, and the securing mechanism temporarily secures the passenger carriage while loading and unloading passengers.

14. The amusement ride system of claim 13, wherein the trolley actuation subsystem comprises a single trolley line drive motor for retracting both the first trolley and the second trolley.

15. The amusement ride system of claim 13, wherein the swing line tension subsystem comprises a single drive motor that controls extension and retraction of both the first swing line and the second swing line.

* * * * *